US008101046B2

(12) United States Patent
Goto et al.

(10) Patent No.: US 8,101,046 B2
(45) Date of Patent: Jan. 24, 2012

(54) METHODS FOR PRODUCING COATING BASE PAPERS AND COATED PAPERS

(75) Inventors: Shisei Goto, Tokyo (JP); Takashi Yamaguchi, Tokyo (JP); Tsukasa Oba, Tokyo (JP); Masaki Ito, Tokyo (JP); Koji Okomori, Tokyo (JP)

(73) Assignee: Nippon Paper Industries, Co. Ltd., Tokyo (JP)

( * ) Notice: Subject to any disclaimer, the term of this patent is extended or adjusted under 35 U.S.C. 154(b) by 86 days.

(21) Appl. No.: 12/594,073

(22) PCT Filed: Mar. 31, 2008

(86) PCT No.: PCT/JP2008/056315

§ 371 (c)(1),
(2), (4) Date: Mar. 1, 2010

(87) PCT Pub. No.: WO2008/123493

PCT Pub. Date: Oct. 16, 2008

(65) Prior Publication Data

US 2010/0300633 A1 Dec. 2, 2010

(30) Foreign Application Priority Data

Mar. 30, 2007 (JP) ..... 2007-095680
Aug. 24, 2007 (JP) ..... 2007-218509
Sep. 28, 2007 (JP) ..... 2007-255380

(51) Int. Cl.
*D21H 11/00* (2006.01)

(52) U.S. Cl. ..... 162/164.6

(58) Field of Classification Search ..... 162/164.6
See application file for complete search history.

(56) References Cited

FOREIGN PATENT DOCUMENTS

| | | |
|---|---|---|
| JP | 10-280296 | 10/1998 |
| JP | 2000-282390 | 10/2000 |
| JP | 2001-262487 | 9/2001 |
| JP | 2002-115197 | 4/2002 |
| JP | 2003-183995 | 7/2003 |
| JP | 2003-212539 | 7/2003 |
| JP | 2004-060084 | 2/2004 |
| JP | 2004-244766 | 9/2004 |
| JP | 2005-002523 | 1/2005 |
| JP | 2005-133238 | 5/2005 |
| JP | 3681655 | 5/2005 |
| JP | 2005-179831 | 7/2005 |
| JP | 2005-206978 | 8/2005 |
| JP | 2005-219945 | 8/2005 |
| JP | 2006-118076 | 5/2006 |
| JP | 2006-118093 | 5/2006 |
| JP | 2006-138044 | 6/2006 |
| JP | 2006-214028 | 8/2006 |
| WO | WO 01/34910 A1 | 5/2001 |

OTHER PUBLICATIONS

JP-2006-118076, translation, May 2006.*
JP 2006-118093, May 2006, translation.*
International Search Report for PCT/JP2008/056315, mailed Jul. 1, 2008.
International Preliminary Report on Patentability and translation of Written Opinion in PCT/JP2008/056315 dated Oct. 13, 2009.

* cited by examiner

*Primary Examiner* — Mark Halpern
(74) *Attorney, Agent, or Firm* — Nixon & Vanderhye, P.C.

(57) ABSTRACT

The present invention provides methods for producing a base paper for coated printing paper and a coated paper by neutral papermaking using a roll and blade gap former type paper machine including a drainage mechanism based on a drainage blade immediately downstream of initial drainage via a forming roll, comprising adding a cationic polyacrylamide-based material having a weight-average molecular weight of 10,000,000 or more determined by intrinsic viscosity measurement as a retention aid to a stock to convert it into paper. According to the present invention, the retention, formation and internal bond strength of the stock can be improved. In the present invention, an anionic microparticle and/or a coagulant can also be used.

13 Claims, 1 Drawing Sheet

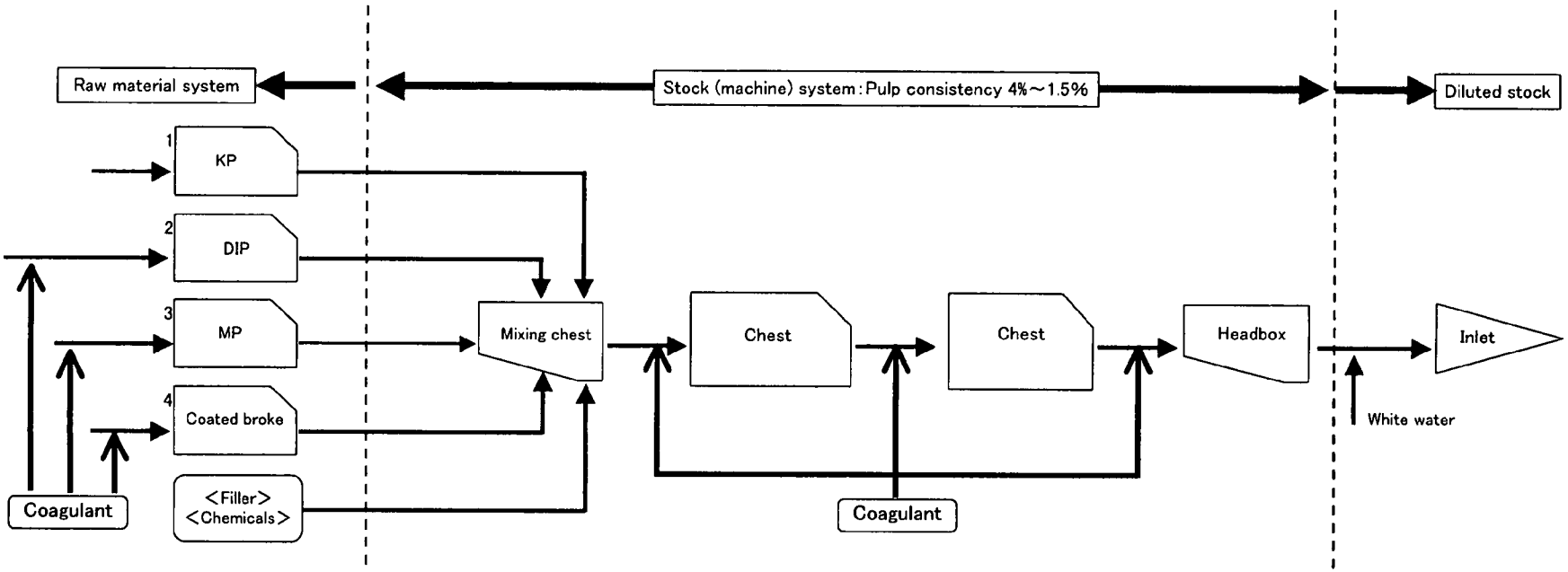
Raw material system
Stock (machine) system : Pulp consistency 4%~1.5%
Diluted stock
1
KP
2
DIP
3
MP
4
Coated broke
Coagulant
<Filler>
<Chemicals>
Mixing chest
Chest
Chest
Coagulant
Headbox
Inlet
White water

METHODS FOR PRODUCING COATING BASE PAPERS AND COATED PAPERS

This application is the U.S. national phase of International Application No. PCT/JP2008/056315 filed 31 Mar. 2008, which designated the U.S. and claims priority to Japan Application Nos. 2007-095680 filed 30 Mar. 2007; 2007-218509 filed 24 Aug. 2007; and 2007-255380 filed 28 Sep. 2007, the entire contents of each of which are hereby incorporated by reference.

TECHNICAL FIELD

The present invention relates to methods for producing coating base papers and methods for producing coated papers using the coating base papers. The present invention also relates to methods for preparing stocks for producing coating base papers. Especially, the present invention relates to those methods at high speed.

BACKGROUND ART

Recently, paper machines have been increasingly developed and improved, and especially, there is an obvious trend to increase speed and width of paper machines for enhanced productivity.

As for the wire part of paper machines, Fourdrinier formers have been replaced by on-top twin wire formers, and then gap formers to improve the drainage capacity. In gap former type paper machines, a stock jet delivered from the headbox is immediately sandwiched between two wire cloths so that the surface of the stock jet is less disturbed, resulting in good surface smoothness. Another advantage of gap former type paper machines is drainage from both sides of paper layers, which makes easier to control drainage levels so that they can operate at higher speed than Fourdrinier or on-top formers and the resulting paper shows little difference in surface smoothness between both sides.

In gap former type paper machines, however, sudden drainage from both sides of paper layers still at very low stock consistency causes the distribution of fines and filler in paper layers to be localized at surfaces and the amount of fines in middle layers of paper tends to decrease. For this reason, gap former type paper machines had disadvantages such as low internal bond strength and low stock and ash retention on the wire during the papermaking process.

Thus, coated printing papers using coating base papers prepared by gap former type paper machines have low internal bond strength so that even if water contained in the coated papers evaporates during heat drying after offset printing, the water cannot pass through coating layers, resulting in separation between paper layers and formation of blisters, i.e. pockets of coating layers, which may cause serious quality problems such as roughened printing surface. This limited the use of gap former type paper machines to the preparation of newsprints or the like.

In order to improve blisters in coated printing papers, the internal bond strength of coating base papers used should be increased. Generally, a method used to improve internal bond strength is to add a dry paper strength agent such as cationized starch or polyacrylamide during the papermaking process. However, even if a dry paper strength agent is added into a stock, it is more likely to be fixed to fines so that it must be added in large quantity to obtain sufficient internal bond strength when fines are localized, which causes problems such as poor freeness or formation. Especially, expensive polyacrylamide increases costs and affects formation due to high cohesion, thereby inviting print quality loss. On the other hand, cationized starch must be added in large quantity as compared with polyacrylamide, which may affect freeness, thereby inviting problems such as drainage failure, an increase in dry load, a decrease in wet web strength, etc.

A method for further improving internal bond strength by applying an external dry paper strength agent in addition to the incorporation of an internal dry paper strength agent has also been proposed (see JPA H10-280296). However, any dry paper strength agent cannot penetrate into base papers and sufficiently perform when fines are localized on paper surfaces as observed in papers prepared by gap former type paper machines, as described above.

Recently, various hardware improvements have been made to solve this problem. Conventional systems entailed significant localization of fines or ash on paper surfaces due to sudden drainage via an instrument such as a forming shoe, forming board, suction box or the like during the initial drainage step, but current so-called roll and blade gap former type paper machines allow for slow drainage by combining initial drainage via a forming roll having a suction with a drainage blade immediately downstream of it, and they also allow for even distribution of fines and filler in paper layers and good formation by applying microturbulence to wet web layers with the aid of a pulse force from the pressing drainage blade to promote the dispersion of fibers. Thus, extremely weak parts disappeared in paper layers, and dry paper strength agents added to the stock can effectively increase paper strength, thereby improving internal bond strength.

However, roll and blade gap former type paper machines improved paper layer structures by slowing initial drainage, but have not significantly improved stock retention loss, which is a problem with conventional gap former type paper machines, because fines and filler within wet web are expelled by pulses applied within wet web under the pressure of the drainage blade.

Thus, a technique for improving retention was proposed, comprising adding a cationic polyacrylamide, then adding an anionic inorganic microparticle such as bentonite or colloidal silica, and further adding an anionic polymer as retention aids to achieve high retention of fines while maintaining good formation (see WO2001/34910). However, sufficient improvement has not been achieved yet in internal bond strength, retention and formation under the current circumstances where the speed, ash content and DIP content are increasing.

On the other hand, on-machine coaters capable of in-line papermaking and coating have been widely adopted in recent years. On-machine coaters have the advantages over off-machine coaters that they are capital- and space-saving and enable rapid coating of base papers, thereby reducing production costs. However, papermaking and coating take place continuously so that a web break results in a significant production efficiency loss such as prolonged feeding period. Especially when a base paper is coated via an on-machine coater having a film transfer coater such as a metering size press coater or gate roll coater, and further coated via an in-line continuous blade coater, web breaks may be likely to occur by the presence of foreign matter on the surface of the base paper. Thus, foreign matter must be minimized for efficient operation of the blade coater, which limited the incorporation of deinked pulp and the like containing much foreign matter. In addition, paper strength must be enhanced to reduce web breaks, which limited the use of gap former type paper machines incapable of conferring high strength as described above.

Sources of the foreign matter include, among others, white pitch derived from coating layers contained in raw materials from defibered broke generated during coating (coated broke), stickies derived from deinked pulp, and natural pitch derived from mechanical pulp. A known measure against such foreign matter including white pitch, stickies and natural pitch is to add a cationic polymer called coagulant to coated broke raw material, deinked pulp or mechanical pulp before mixing during the stock preparation step (JPA 2005-206978, JPA 2005-179831, JPA 2005-133238, JPA 2004-60084, JPA 2001-262487, Japanese Patent No. 3681655, JPA 2005-2523). Generally, coagulants are thought to neutralize the surface charge on anionic colloidal particles including white pitch, stickies and natural pitch so that the anionic colloidal particles are loosely fixed in the form of smallest possible particles to fibers to form soft flocks, thereby reducing problems of foreign matter.

Various methods for adding a coagulant to a raw material before mixing have been reported. For example, they include adding a coagulant to waste paper pulp before it is fed to the raw material preparation step of a paper machine (JPA 2005-206978), adding a coagulant to waste paper pulp before it is fed from the waste paper regenerating step to the mixing chest (JPA 2005-179831, JPA 2005-133238), adding a coagulant to a plurality of stocks during the stock preparation step before they are fed to the headbox (JPA 2004-60084), adding a cationic water-soluble polymer to a raw material based on magazine waste paper before mixing (JPA 2001-262487), etc. Other methods have also been reported, including adding a cationic water-soluble polymer to each of one or more papermaking raw materials before mixing and then adding a cationic polymer retention aid to a raw material mixture containing the papermaking raw material mixed with other papermaking raw materials (Japanese Patent No. 3681655), adding a cationic polymer during the defibering step after a mixture of recovered clarified water and coated broke has been combined with another pulp (JPA 2005-2523), etc.

However, coagulants have the disadvantages that the effect of the coagulants added to raw materials gradually decrease through steps and fixed colloidal particles are detached especially in high-speed paper machines generating a strong shearing force, because the coagulants form soft flocks loosely bound to fibers as described above. This required excessive amounts of coagulants to be added to neutralize the charge of colloidal particles again or additional amounts of retention aids to be incorporated to fix detached particles again, which invited not only a cost disadvantage but also problems such as secondary deposits formed by foreign matter modestly grown into coarse particles and excessive amounts of cationic chemicals. Generally, it is known that when a cationic chemical having a high molecular weight is added to coarse particles of foreign matter, the coarse particles of foreign matter are fixed to paper, resulting in an increase of paper defects or web breaks.

Another known method is to add a mixture of a cationic polymer and a cationic monomer to a papermaking raw material composition containing a plurality of pulps (JPA 2003-183995). However, this method comprises adding the coagulant after colloidal substances have grown into coarse particles or foreign matter has been destabilized upon contact with other pulps or chemicals, which may cause problems of foreign matter on paper surfaces and rather lead to web breaks.

Still another report proposes a method comprising adding a cationic retention/freeness aid in a papermaking system wherein at least one of a polyvalent metal salt and a cationic polymer is divided and added to at least two sites (JPA 2000-282390). In this method, however, the cationic polymer is added to a stock containing raw materials in order to improve retention, which rather positively encourages colloidal substances or the like to form coarse particles. Thus, this method cannot reduce runnability problems such as deposits from coated broke, deinked pulp and mechanical pulp or web breaks as described above, but rather may induce these problems.

Still another report proposes to add a coagulant during the step of preparing a stock containing a plurality of pulps and the step of feeding it from the headbox to the wire part (JPA 2006-138044). This method comprises adding the coagulant upstream of the screen downstream of the secondary pump to the stock containing a lot of white water typically to a solids content of less than 1.5% downstream of the headbox, and further adding a flocculant downstream of the screen. However, this method also fails to reduce runnability problems such as deposits from coated broke, deinked pulp and mechanical pulp or web breaks as described above, but rather may induce these problems.

In this manner, conventional techniques could not avoid problems such as deposits from coarse particles of colloidal substances or foreign matter and could not sufficiently overcome productivity loss, especially during the preparation of coating base papers in high-speed paper machines. To fix this foreign matter to fibers, excessive retention aids had to be added, resulting in paper quality loss such as uneven formation or filler distribution. Especially when a coated paper is produced continuously in-line using a coater from a coating base paper prepared in a high-speed paper machine such as gap former type paper machine, runnability problems such as web breaks could not be avoided, resulting in productivity loss and sometimes paper quality loss.

DISCLOSURE OF THE INVENTION

Under these circumstances, an object of the present invention is to provide a method for producing a base paper for coated printing paper by neutral papermaking using a roll and blade gap former type paper machine including a drainage mechanism based on a drainage blade immediately downstream of initial drainage via a forming roll, wherein the retention of fine components such as fine pulp fibers and filler in the stock on the wire can be significantly improved and the resulting base paper for coated printing paper has good formation and internal bond strength especially even when a base paper for coated printing paper having a high filler content in the paper is prepared under high-speed conditions. Another object of the present invention is to provide a method for producing a coated paper having good print quality such as blister resistance.

Another object of the present invention is to provide a method for producing a coating base paper simultaneously having high retention and even filler distribution and good formation while reducing runnability problems such as deposits especially during the papermaking process in a paper machine at high speed. Still another object of the present invention is to provide a method for producing a coated paper having good quality free from runnability problems such as web breaks when a coating base paper is coated via a coater. Still another object of the present invention is to provide a process for preparing a stock for producing a paper simultaneously having high retention and even filler distribution and good formation while reducing runnability problems such as deposits during the papermaking process in a paper machine.

As a result of careful studies to improve retention and quality as coating base paper when a base paper for coated printing paper is prepared by using a roll and blade gap former type paper machine including a drainage mechanism based on a drainage blade immediately downstream of initial drainage via a forming roll, we achieved the present invention on the basis of the finding that retention can be improved and internal bond strength is good while maintaining even distribution of fines or filler in the paper layers and good formation by using a ultra high molecular weight cationic polyacrylamide-based material as a retention aid. By carrying out the present invention, high retention and internal bond strength can be attained while maintaining good paper formation. The present invention is more effective especially when it is applied to the preparation of base papers for coated printing paper having a high filler content at high machine speed.

We also found that high internal bond strength is conferred and stock retention can also be improved while maintaining good freeness and formation by using a cationized starch as a paper strength aid and adding a cationic polyacrylamide-based material and an anionic microparticle as retention aids in this order. The cationized starch here may be added at any point, but preferably before the retention aids. Moreover, a coated paper having good print quality such as blister resistance can be obtained by a method for producing a coated printing paper, comprising coating this base paper for coated printing paper with a coating layer color containing a pigment and an adhesive. The present invention is more effective especially when it is applied to the preparation of base papers for coated printing paper having a high filler content in paper at high machine speed. A coated paper having high coating speed and good print quality such as blister resistance can also be obtained by a method for producing a coated printing paper, comprising coating this coating base paper with a coating layer color containing a pigment and an adhesive.

As a result of careful studies about a papermaking process capable of preventing free colloidal particles and foreign matter from forming coarse particles or deposits and providing high retention and even filler distribution and good formation, we also achieved the present invention on the basis of the finding that this challenge can be solved by adding a coagulant at multiple stages during the stock preparation step in a paper machine including at least one or more papermaking raw materials before mixing and a stock having a solids content of 1.5% or more containing a plurality of raw materials. By carrying out the present invention, colloidal particles and foreign matter can be fixed in a microscopic form to fibers and even after a high shearing force has been applied, they resist being redispersed and even dispersed particles can be rapidly fixed again. In the present invention, a sufficient retention effect can be attained when a retention aid is added after the coagulant has been added, whereby high retention and even filler distribution and good formation can be achieved, and high internal bond strength and stock retention can be obtained while maintaining good paper formation.

The present invention is especially suitable when a gap former type paper machine or twin wire paper machine is used especially at high machine speed, or when an on-machine coater including a film transfer coater such as a metering size press coater or gate roll coater in the paper machine is used for coating, or when a coating color is applied via an on-machine coater including a film transfer coater followed by an in-line blade coater, whereby good quality coating base papers and coated papers with little problems such as defects on paper surfaces and web breaks.

BRIEF DESCRIPTION OF THE DRAWING

FIG. 1 is a schematic diagram showing an embodiment of a method for adding a coagulant in the present invention.

BEST MODE FOR CARRYING OUT THE INVENTION

The present invention relates to a method for producing a coating base paper by neutral papermaking using a roll and blade gap former type paper machine including a drainage mechanism based on a drainage blade immediately downstream of initial drainage via a forming roll.

When base papers for coated printing paper are made under high-speed conditions using gap former type paper machines conventionally applied to relatively high-speed papermaking, the difference in surface smoothness between both sides is improved because of drainage from both sides of paper layers, but such problems occur as localization of fine components on paper surfaces and unstable operation due to low retention.

Roll and blade gap former type paper machines capable of evenly distributing fine components in paper layers improved these problems, but even such machines fail to control drainage balance when retention loss of fines increases so that fine components in paper layers are localized and the difference in surface smoothness between both sides increases.

Generally, stock retention tends to decrease with increase in the machine speed of the paper machine, increase in filler content in paper and decrease in basis weight, but there is a trend toward high speed, high ash content and low basis weight in the current methods for making papers including base papers for coated printing paper.

Therefore, the method for producing a base paper for coated printing paper according to the present invention is a process using a roll and blade gap former type paper machine including a drainage mechanism based on a drainage blade immediately downstream of initial drainage via a forming roll, preferably a process using the roll and blade gap former type paper machine at high machine speed, more preferably a process using the roll and blade gap former type paper machine wherein the base paper for coated printing paper is prepared at high machine speed and high filler content in paper.

The present invention is more effective and suitable when it is applied to high-speed papermaking. As used herein, high speed means 1000 m/min or more, preferably 1200 m/min or more, more preferably 1300 m/min or more. The present invention is especially suitable for papermaking at 1500 m/min or more, or even papermaking at 1600 m/min or more, or about 2500 m/min, in view of the great effect offered by the present invention in such application.

Cationic Polyacrylamide-Based Retention Aids

The present invention involves adding a straight or branched cationic polyacrylamide (PAM)-based material having a weight-average molecular weight of 10,000,000 or more, preferably 12,000,000 or more determined by intrinsic viscosity measurement as a retention aid to a stock to convert it into paper. The cationic polyacrylamide-based retention aid of the present invention favorably has a molecular weight of 15,000,000 or more, in which case coating base papers having excellent formation and internal bond strength can be prepared at high retention without using the anionic microparticle described below.

The cationic polyacrylamide-based material used in the methods of the present invention may be in the form of an emulsion or solution. Specific compositions are not specifically limited so far as they contain an acrylamide monomer unit as a base unit in the material, and include, for example, copolymers of a quaternary ammonium salt of an acrylic acid ester with acrylamide, or quaternized ammonium salts of a copolymer of acrylamide with an acrylic acid ester. The cationic charge density of the cationic polyacrylamide-based material is not specifically limited, but the cationic charge density is preferably higher, specifically 1.0 meq/g or more, more preferably 1.5 meq/g or more, still more preferably 2.0 meq/g or more to increase the retention because stocks for base papers for coated printing paper contain much anionic materials from coating colors so that they have very high cationic demands. If the cationic charge density exceeds 10.0 meq/g, the charge balance in the system may unfavorably change to positive.

During the pretreatment step before the paper machine, a stock obtained by mixing pulp raw materials and internal papermaking chemicals in a mixer is typically combined with a fresh filler upstream of the fan pump and homogeneously mixed. Thus, the cationic polyacrylamide-based material is preferably added downstream of the loading site of this filler and upstream of the stock inlet of the paper machine. When it is used in combination with the anionic microparticle described below, the cationic polyacrylamide retention aid of the present invention is preferably added downstream of the loading site of the filler and upstream of the primary screen, considering that the anionic microparticle is added later.

The amount of the cationic polyacrylamide-based material added as a retention aid is appropriately determined depending on the properties of the stock and machine speed, but typically 50-750 ppm, preferably 50-600 ppm, more preferably 100-600 ppm, still more preferably 100-500 ppm based on the solids weight of the stock. If the content of the cationic polymer material is less than 50 ppm, the resulting base paper for coated printing paper exhibits good formation, but insufficient retention of fine components. If it exceeds 750 ppm, the retention of fine components increases but formation deteriorates, thereby causing printing failure problems such as uneven printing due to uneven formation.

In one embodiment, the present invention provides a method for producing a base paper for coated printing paper by neutral papermaking using a roll and blade gap former type paper machine including a drainage mechanism based on a drainage blade immediately downstream of initial drainage via a forming roll, characterized in that a cationic polyacrylamide-based material having a weight-average molecular weight of 15,000,000 or more determined by intrinsic viscosity measurement is added as a retention aid to a stock to convert it into paper.

In another embodiment, the present invention provides the method for producing a base paper for coated printing paper wherein the machine speed is 1300 m/min or more.

In still another embodiment, the present invention provides the method for producing a base paper for coated printing paper wherein the ash content in the base paper for coated printing paper is 10% or more.

In still another embodiment, the present invention provides the method for producing a base paper for coated printing paper wherein the raw material pulp contains 20% or more of deinked pulp (DIP).

In still another embodiment, the present invention provides the method for producing a base paper for coated printing paper characterized in that a shoe press is used in the press part of the gap former type paper machine.

In another aspect, the present invention provides a method for producing a coated printing paper, comprising applying a coating color containing a pigment and an adhesive on a base paper for coated printing paper obtained by the methods above.

Combination of a Cationized Starch and an Anionic Microparticle

In the present invention, it is preferred that at least one or more anionic microparticles are used as a retention aid in combination with the cationic polyacrylamide-based material, and that a cationized starch is also used as a paper strength aid because good retention and formation can be obtained. When a cationic polyacrylamide-based retention aid and an anionic microparticle retention aid are used in combination in the present invention, the cationic polyacrylamide-based material is preferably added first and then the anionic microparticle.

In one embodiment, therefore, the method for producing a base paper for coated printing paper comprises adding a cationized starch as a paper strength aid to a stock, and adding an anionic microparticle after the addition of the cationic polyacrylamide-based material.

In the process of the present invention, a cationized starch is preferably used as a paper strength aid. The cationized starch may be a tertiary amine or quaternary ammonium derivative. The charge density of the cationized starch is not specifically limited, but good paper strength improvement effect cannot be expected if the cationic charge density is low because the cationized starch often contains much anionic material from the coating solution so that it has very high cationic demand. Specifically, it is preferably 0.1 meq/g or more, more preferably 0.15 meq/g or more.

The amount of the cationized starch added as a paper strength aid is appropriately determined depending on the required quality of the coated paper, the properties of the stock and machine speed, but typically 0.1-3.0%, preferably 0.3-3.0%, more preferably 0.3-2.0% based on the solids weight of the stock. If the content of the cationized starch is less than 0.1%, internal bond strength sufficient for a base paper for coated printing paper cannot be obtained. If it exceeds 3.0%, internal bond strength increases, but freeness on the wire or water drainage in the press deteriorates, which invites problems such as drainage failure or dry load increase.

Anionic microparticles used as a retention aid in the present invention include inorganic microparticles such as bentonite, colloidal silica, polysilicic acid, microgels of polysilicic acid or polysilicic acid salts and aluminum-modified products thereof, and organic microparticles having a particle size of 100 μm or less crosslinked/polymerized with acrylamide called micropolymers, and one or more of the anionic microparticles can be used. Preferred inorganic microparticles include bentonite or colloidal silica. Preferred organic microparticles include acrylic acid/acrylamide copolymers. When an inorganic microparticle and an organic microparticle are used in combination, bentonite or colloidal silica is preferably used with an acrylic acid/acrylamide copolymer as a preferred organic microparticle.

The anionic microparticle is preferably added downstream of the loading site of the cationic polyacrylamide-based material, more preferably downstream of the loading site of the cationic polyacrylamide-based material and upstream of the stock inlet of the paper machine. When an inorganic microparticle and an organic microparticle are used as anionic microparticles in combination, they may be added simultaneously or separately, but the inorganic microparticle is preferably added first and then the organic microparticle.

The amount of the anionic microparticle added as a retention aid is also appropriately determined depending on the stock and papermaking conditions in the same manner as described about the cationic polyacrylamide. Typically, it is 300-3000 ppm, preferably 400-2500 ppm, more preferably 500-2000 ppm based on the solids weight of the stock. This content also applies to combinations of an inorganic microparticle and an organic microparticle, in which case it represents the total content of the inorganic microparticle and the organic microparticle. Here, the ratio of the inorganic microparticle and the organic microparticle is preferably 20:1-2:1, more preferably 10:1-3:1. If the content of the anionic microparticle is less than 300 ppm, the freeness impaired by the cationized starch added as an internal paper strength aid is insufficiently restored, and if it exceeds 3000 ppm, no more improvement can be expected.

In one embodiment, the present invention provides a method for producing a base paper for coated printing paper by neutral papermaking using a roll and blade gap former type paper machine including a drainage mechanism based on a drainage blade immediately downstream of initial drainage via a forming roll, characterized in that a cationized starch is used as a paper strength aid in a stock, and a cationic polyacrylamide-based material is added followed by an anionic microparticle as retention aids.

In another embodiment, the present invention provides the method for producing a base paper for coated printing paper wherein the machine speed is 1300 m/min or more.

In still another embodiment, the present invention provides the method for producing a base paper for coated printing paper wherein the cationic polyacrylamide-based material has a weight-average molecular weight of 10,000,000 or more determined by intrinsic viscosity measurement.

In still another embodiment, the present invention provides the method for producing a base paper for coated printing paper wherein the filler content in the coating base paper is 10% solids by weight or more.

In still another embodiment, the present invention provides the method for producing a base paper for coated printing paper wherein the raw material pulp contains 20% by weight or more of deinked pulp.

In another aspect, the present invention provides a method for producing a coated printing paper, comprising applying a coating color containing a pigment and an adhesive on a base paper for coated printing paper obtained by the methods above.

Coagulants

In preferred embodiments of the methods for preparing a coating base paper according to the present invention, a coagulant can be used, whereby the retention can be increased. In the present invention, an inorganic coagulant such as aluminum sulfate or polyaluminum chloride, or an organic coagulant such as polyamine, polyethyleneimine, polyvinylamine, polyDADMAC (diallyldimethylammonium chloride homopolymer) or a copolymer of polyDADMAC and acrylamide may be added, for example, so far as the advantages of the present invention are not affected.

In preferred embodiments of the present invention, a coagulant can be added at multiple stages, preferably to at least one or more papermaking raw materials before mixing and a stock having a solids content of 1.5% or more containing the papermaking raw materials.

As used herein, various raw materials before mixing are referred to as papermaking raw materials or raw materials, and various pulps before mixing are one of the raw materials. A mixture containing various raw materials is collectively referred to as stock. Thus, stocks in the present invention may contain filler and chemicals in addition to pulp. Moreover, a stock mixture diluted with white water or process water downstream of the headbox to a solids content of less than 1.5% is herein sometimes referred to as inlet raw material. Sometimes as used herein, a set of papermaking raw materials before mixing is referred to as raw material system, and a mixture containing various raw materials is referred to as stock system.

In the present invention, a coagulant is added to at least various raw materials (raw material system) and a stock containing the raw materials (stock system), and the stock containing the raw materials has a solids content of 1.5% or more. By adding a coagulant in this manner, colloidal particles can be fixed in a microscopic form to fibers, thereby preventing colloidal particles from being detached over time. In the present invention, the coagulant is added at multiple stages, but the number of additions is not specifically limited.

The type of the coagulant added in the present invention is not specifically limited, but preferably a coagulant having a charge density of 3.0 meq./g or more in terms of charge neutralization and a weight-average molecular weight of 300,000 or more, especially a copolymer of acrylamide and a diallyldimethylammonium salt or a polyvinylamine derivative. A single coagulant may be divided and used in different raw materials, or varying types of coagulants may be added to different raw materials, or two or more coagulants may be added to the same raw material. A single coagulant is preferably used for economy and workability, and a coagulant having a weight-average molecular weight of 1,000,000 or more is preferably added to coated broke or DIP or a coagulant having a charge density of 5.0 meq./g or more is preferably added to mechanical pulp for enhanced effects. Also when a coagulant is added to a stock mixture, a single coagulant may be divided and added to multiple sites, or two or more coagulants may be added to multiple sites or the same site. Also when a coagulant is added to a raw material and a stock, a single coagulant may be divided, or two or more coagulants may be used separately or as a mixture.

Coagulants of the present invention include cationic polymers such as polyethyleneimines and modified polyethyleneimines containing a tertiary and/or quaternary ammonium group, polyalkyleneimines, dicyandiamide polymers, polyamines, polyamine/epichlorohydrin polymers, and dialkyldiallyl quaternary ammonium monomers, dialkylaminoalkyl acrylates, dialkylaminoalkyl methacrylates, dialkylaminoalkyl acrylamide/acrylamide polymers, dialkylaminoalkyl methacrylamide/acrylamide polymers, monoamine/epihalohydrin polymers, polyvinylamines and polymers having a vinylamine moiety as well as mixtures thereof; cation-rich zwitterionic polymers having an anionic group such as carboxyl or sulfone copolymerized in the molecules of the polymers above; and mixtures of a cationic polymer and an anionic or zwitterionic polymer.

Generally, coagulants are thought to neutralize the surface charge on anionic colloidal particles including white pitch, stickies and natural pitch so that the anionic colloidal particles are loosely fixed in the form of smallest possible particles to fibers to form so-called soft flocks, thereby reducing problems of foreign matter. Internal chemicals contrasting coagulants include cationic polymers called retention aids or freeness aids known to flocculate colloidal particles or the like into coarse particles, which are firmly bound to fibers to form agglomerates (called hard flocks).

The effect of a coagulant can be evaluated on the basis of cationic demand and turbidity. Cationic demand refers to the amount of cationic charge required to neutralize anionic colloidal particles and serves to evaluate the degree of neutralization of anionic colloidal particles including white pitch, stickies and natural pitch. The amount of particles can be evaluated as turbidity. Thus, a test of whether or not a coagulant neutralizes the charge of anionic colloidal particles and efficiently fixes them to fibers can be evaluated on the basis of the decrease (reduction ratio) in cationic demand and turbidity.

In the present invention, a coagulant is added to at least one or more papermaking raw materials before mixing. Papermaking raw materials include, but not limited to, pulps, fillers, chemicals, etc. Pulps include softwood or hardwood kraft pulp (NKP or LKP); pulp derived from sorted or unsorted waste papers including waste newspaper, waste magazine paper and waste advertising leaflets, or office waste papers including toner prints, or recovered data recording papers including carbonless copying paper and heat-sensitive transfer paper, which are used alone or as a mixture and subjected to defibering, dedusting, deinking, washing or dewatering (herein referred to as deinked pulp: DIP); mechanical pulp such as softwood or hardwood groundwood pulp (GP), refiner groundwood pulp (RGP), thermomechanical pulp (TMP), chemithermomechanical pulp (CTMP), chemi-groundwood pulp (CGP) or semichemical pulp (SCP); coated broke derived from defibered broke including coated paper or coating base paper and other papers; and mixtures of two or more of them. Desirably, a coagulant is added immediately before each raw material is completed, and maintained with stirring in a tank or chest, but may also be added immediately before the mixing chest so far as the raw material comes into contact with other raw materials, such as in a pipe through which it is sent to the mixing chest or at the inlet or outlet of a pump.

In the present invention, the coagulant is added to at least a stock having a solids content of 1.5% or more containing a plurality of raw materials. The solids content of the stock to which it is added is more preferably 1.8% or more, still more preferably 2.0% or more, and preferably 4.0% or less. This stock may contain various pulps and filler and internal chemicals.

The coagulant can be added to a stock system, specifically downstream of the mixing chest and before the stock is diluted with white water or process water downstream of the headbox. The coagulant can be added to the stock in a chest or at the inlet or outlet of a pump, and if multiple such chests or pumps exist, it can be added at multiple sites.

FIG. 1 shows an embodiment of a method for adding a coagulant in the present invention. In FIG. 1, references 1-4 represent tanks or chests in which finished pulps of hardwood or softwood pulp, deinked pulp, mechanical pulp and coated broke are stored. Various raw materials are fed via pumps, and mixed with filler, chemicals and the like in the mixing chest. The resulting stock mixture is fed through necessary equipment such as chests, headbox, screen and cleaner to the inlet of a paper machine. In the methods of the present invention, the stock in the inlet is delivered on the wire to form a wet web, which is then dried to prepare a coating base paper.

Thus, the addition of a coagulant to a papermaking raw material in the present invention can take place in a tank or chest where the papermaking raw material is stored or a pipe leading to it. The addition of a coagulant to a stock can take place in the mixing chest, various chests downstream of the mixing chest or the headbox, and a pipe leading to it.

The amount of the coagulant added is desirably 50-3000 ppm expressed as total active ingredient level contained in the coagulant excluding water based on the solids of the slurry of interest. If it is less than 50 ppm, each dose of the coagulant divided and added to a raw material and a stock is too small to provide a sufficient fixing effect. If it exceeds 3000 ppm, cost disadvantages occur. At a single site, 2000 ppm or less is preferably added to avoid overcoagulation due to excessive cations.

The amount of the coagulant added to a raw material is preferably 50-1500 ppm, more preferably 100-1000 ppm. The amount of the coagulant added to a stock is preferably 100 ppm-1000 ppm, more preferably 200 ppm-800 ppm.

The consistency of the raw material to which the coagulant is added is more preferably 2.5% or more and less than 5%. If the consistency of the raw material is less than 2.5%, a lot of the coagulant is consumed to neutralize colloidal substances contained in the white water used so that it becomes difficult to efficiently fix colloidal substances contained in the raw material to fibers while they remain in a microscopic form, and the consistency of the subsequent stock mixture decreases and therefore, the consistency window decreases, resulting in unstable operation. If the consistency of the raw material is 5% or more, however, the coagulant and the raw material are not sufficiently mixed and the coagulant locally acts to readily form coarse particles of foreign matter due to overcoagulation.

On the other hand, the consistency of the stock to which the coagulant is added is preferably 1.5% or more and less than 4%, more preferably 1.8% or more, still more preferably 2% or more. If it is less than 1.5%, the proportion of white water circulating especially around the inlet increases so that already grown large foreign matter contained in it is fixed to fibers, whereby problems such as defects on paper surfaces or web breaks increase. If it is 4% or more, any sufficient effect cannot be obtained because of insufficient mixing as described for the addition to the raw material.

According to the present invention, web breaks or defects on paper surfaces resulting from foreign matter derived from fine stickies can be reduced especially by adding a coagulant to DIP as a raw material and adding a coagulant to a stock mixture, and this effect is especially remarkable when the DIP content in the stock is 10% or more.

Moreover, the use of the present invention allows for stable production of coating base papers especially containing mechanical pulp. Mechanical pulp contains organic acids such as resin acids and fatty acids typical of anionic trash. When these organic acids react with calcium ion in DIP or coated broke or react with calcium carbonate added as an internal filler to form an organic acid calcium salt, consistency increases to invite problems of deposits. Thus, the problems of deposits can be lessened and the occurrence of web breaks or the like can be reduced by adding a coagulant to mechanical pulp to block these organic acids, and then fixing them with a coagulant again after mixing the pulp with the other raw materials. The effect of the present invention is especially remarkable when the mechanical pulp content in a stock is 5% or more because the anionic trash content measured in mechanical pulp is 5-20 times higher than those of DIP and KP expressed as cationic demand measured as an indicator.

Moreover, the present invention can be suitably applied to papermaking methods using coated broke as a papermaking raw material. Considering that coated broke derived from re-defibered broke generated during the preparation of coating base paper contains hydrophobic microparticles such as latex, good runnability can be attained especially when the present invention is applied to coated broke. A preferred proportion of coated broke in a stock is preferably 1% or more and less than 50%, especially less than 40%. The effect can be stably obtained by keeping the broke content as constant as possible.

Preferred techniques for obtaining coated papers include methods using a gap former type paper machine including an on-machine coater, or methods using a gap former type paper machine including an on-machine coater and also using a blade coater for coating, especially methods conveniently used at high machine speed and coating speed. The present invention is more effective when the papermaking process through the coating step take place continuously in-line using a gap former type paper machine including an on-machine coater, and the finishing step also takes place in-line.

In the present invention, a coagulant can also be added to a stock mixture after a cationic polyvalent metal salt has been added. According to this embodiment, anionic trash coming from various raw materials can be effectively neutralized and the effect of the coagulant for encouraging detached colloidal substances to be refixed can be amplified. Cationic polyvalent metal salts include aluminum sulfate, aluminum chloride, PAC (polyaluminum chloride), ferric chloride, ferric polysulfate, etc. The content of these metal salts is not specifically limited, but preferably 3% or less, especially 2% or less as neat based on the solids of the stock. It is unsuitable to add more than 3%, because pH variations tend to increase, resulting in unstable operation.

When a retention aid is used in the present invention, it is preferable but not necessary to add a retention aid consisting of a polymer after a coagulant has been added. This is because if a coagulant is added followed by a retention aid, a sufficient retention effect is produced so that papers having good formation and filler distribution can be obtained. The retention aid consisting of a polymer may be a cationic polyacrylamide-based material; or a retention system called dual polymer using said material in combination with at least one or more cationic coagulants; or a retention system using at least one or more anionic inorganic microparticles such as bentonite, colloidal silica, polysilicic acid, microgels of polysilicic acid or polysilicic acid salts and aluminum-modified products thereof, or one or more organic microparticles having a particle size of 100 μm or less crosslinked/polymerized with acrylamide called micropolymers. Especially when the cationic polyacrylamide-based materials used alone or in combination are straight or branched polymers having a weight-average molecular weight of 10,000,000 or more, preferably 12,000,000 or more determined by intrinsic viscosity measurement, good retention can be achieved, and if they are those acrylamide-based materials having a molecular weight of 15,000,000 or more and less than 30,000,000, very high retention can be achieved.

The present invention includes, but not limited to, the following aspects:

(1) A method for producing a coating base paper characterized in that a coagulant is added to at least one or more papermaking raw materials before mixing and a stock having a solids content of 1.5% or more containing the papermaking raw materials.

(2) The method for producing a coating base paper as defined in (1) characterized in that the addition of a coagulant to a stock having a solids content of 1.5% or more takes place after one or more papermaking raw materials have been incorporated and before the stock is diluted with white water or process water downstream of the headbox.

(3) The method for producing a coating base paper as defined in (1) or (2) using a paper machine having a wire speed of 1200 m/min or more characterized in that the coagulant is added at 50-3000 ppm expressed as total active ingredient level based on the solids of the stock.

(4) The method for producing a coating base paper as defined in any one of (1)-(3) characterized in that the process is performed by neutral papermaking using a roll and blade gap former type paper machine including a drainage mechanism based on a drainage blade immediately downstream of initial drainage via a forming roll.

(5) The method for producing a coating base paper as defined in any one of (1)-(4) using a paper machine including an on-machine coater characterized in that a part of the coagulant is added to a coated broke raw material before mixing.

(6) The method for producing a coating base paper as defined in any one of (1)-(5) characterized in that the stock mixture contains 10% or more of deinked pulp.

(7) The method for producing a coating base paper as defined in any one of (1)-(6) characterized in that the coagulant is added to at least a coated broke raw material and a stock containing one or more papermaking raw materials including the coated broke raw material and a cationic polyvalent metal salt subsequently added.

(8) The method for producing a coated paper as defined in any one of (1)-(7) using a paper machine including an on-machine coater characterized in that a coating base paper is obtained and then coated with a coating color containing a pigment and an adhesive via a blade coater.

(9) A method for preparing a stock characterized in that a coagulant is added to at least one or more papermaking raw materials before mixing and a stock having a solids content of 1.5% or more containing the papermaking raw materials.

Papermaking Raw Materials

Pulp raw materials for base papers for coated printing paper prepared by the present invention are not specifically limited, but may be those conventionally used as papermaking raw materials for printing papers such as mechanical pulp (MP), deinked pulp (DIP), hardwood kraft pulp (LKP), softwood kraft pulp (NKP), etc., which may be used alone or as a mixture of two or more of them, as appropriate. Mechanical pulps include groundwood pulp (GP), refiner groundwood pulp (RGP), thermomechanical pulp (TMP), chemithermomechanical pulp (CTMP), chemigroundwood pulp (CGP), semichemical pulp (SCP), etc. Deinked pulp is not specifically limited, and may be those derived from raw materials such as sorted waste papers including woodfree paper, mechanical paper, groundwood paper, news, advertising leaflets and magazines or unsorted waste papers including mixtures thereof. In the present invention, improvements in formation, retention and internal bond strength can be achieved even if deinked pulp is incorporated at 20% by weight or more, or 30% by weight or more, or even 50% by weight or more of the total pulp composition.

Fillers used in the present invention may be any known ones, typically including particles called inorganic fillers and organic fillers or mixtures thereof. Specifically, inorganic fillers include, for example, ground calcium carbonate, precipitated calcium carbonate, clay, silica, precipitated calcium carbonate-silica complexes, kaolin, calcined kaolin, delaminated kaolin, magnesium carbonate, barium carbonate, barium sulfate, aluminum hydroxide, calcium hydroxide, magnesium hydroxide, zinc hydroxide, zinc oxide, talc, zinc stearate, titanium oxide, amorphous silica prepared by neutralization of sodium silicate with mineral acids, silica prepared from sodium silicate and mineral acids (white carbon, silica/calcium carbonate complexes, silica/titanium dioxide complexes, etc.), titanium dioxide, terra alba, bentonite, kieselguhr, calcium sulfate, inorganic fillers obtained by regenerating ash from the deinking step, and inorganic fillers consisting of complexes formed with silica or calcium carbonate during the regeneration step. Examples of calcium carbonate-silica complexes include complexes described in JPA 2003-212539 and JPA 2005-219945. Amorphous silica such as white carbon may be used in combination with calcium carbonate and/or precipitated calcium carbonate-silica complexes. Among them, typical fillers in neutral and alkaline papermaking such as calcium carbonate and precipitated calcium carbonate-silica complexes are preferably used. Organic fillers include melamine resins, urea-formalin resins, polystyrene resins, phenol resins, hollow microparticles, acrylamide complexes, wood-derived materials (fines, microfibrils, kenaf powder), modified/insolubilized starch, ungelatinized starch, etc. They may be used alone or as a combination of two or more of them.

The filler content in base papers for coated printing paper prepared by the present invention is preferably 1-40% solids by weight, more preferably 5-35% solids by weight. As the filler content in paper increases, the retention in papermaking decreases. Thus, the present invention is more effective when it is applied to the preparation of base papers for coated printing paper having higher filler contents. From this regard, the filler content in paper is preferably 10-40% solids by weight, more preferably 12-35% solids by weight.

Neutral Papermaking

Neutral papermaking in the present invention preferably takes place at pH 6.0-9.0, more preferably 7.0-8.5. Considering that the present invention relates to neutral papermaking, it is especially preferable to internally add calcium carbonate as filler. By adding calcium carbonate, coating base papers having high brightness and high opacity can be obtained at low costs.

Internal Chemicals

Internal chemicals such as dry paper strength aids, wet paper strength aids, freeness aids, dyes and sizing agents may be used as appropriate. Dry paper strength aids include polyacrylamide and cationized starch, while wet paper strength aids include polyamide-amine-epichlorohydrin, etc. Cationic, zwitterionic and anionic modified starches may also be used. Sizing agents include rosin emulsions, styrene-acrylic copolymers, alkyl ketene dimers and alkenyl succinic anhydride, neutral rosin sizing agent, etc. Other conventional internal chemicals such as freeness aids, colorants, dyes and fluorescent dyes as well as paper bulking agents for increasing the bulk (i.e., lowering the density) of paper can also be used. These chemicals are added so far as formation and workability are not affected.

Specific compounds of paper bulking agents include, but not limited to, fat-based nonionic surfactants, sugar alcohol-based nonionic surfactants, sugar-based nonionic surfactants, polyhydric alcohol-based nonionic surfactants, ester compounds of polyhydric alcohols and fatty acids, polyoxyalkylene adducts of higher alcohols or higher fatty acids, polyoxyalkylene adducts of higher fatty acid esters, polyoxyalkylene adducts of ester compounds of polyhydric alcohols and fatty acids, fatty acid polyamide amines, fatty acid diamide amines, fatty acid monoamides, etc. The present invention is preferably applied to stocks containing a bulking agent to maintain paper strength because paper strength tends to decrease by using bulking agents.

Paper Machines

The forming part in the methods of the present invention consists of a roll and blade gap former, wherein initial drainage takes place in the lap area of a forming roll having a vacuum immediately followed by blade drainage via a pressing blade module. This mechanism allows for slower drainage than obtained by conventional formers so that papers having uniform paper layer structure or formation can be obtained. The forming roll used here desirably has a diameter of 1500 mm or more because a sufficient wrap angle cannot be obtained for adequate drainage control if the diameter is small. Dryness can be controlled by using a drainage apparatus such as a suction unit or high-vacuum suction box as appropriate in addition to and downstream of the drainage mechanism consisting of a forming roll or blade. Drainage conditions such as blade pressure are not specifically limited, but can be appropriately established within the range of conventional operation.

The press part in the methods of the present invention preferably uses a shoe press, more preferably uses treatment at two or more stages when the machine speed is high, thereby improving post-press dryness, and therefore improving strength such as internal bond strength or breaking length. The shoe press of the present invention may have a nip width in the range of about 150-250 mm, and may be a type in which a web is passed between a rotating press roll and a hydraulically lifted pressing shoe via a sleeve running between the felt and the pressing shoe. The pressing pressure can be appropriately controlled depending on the moisture content at the outlet of the press and the difference in paper smoothness between both sides, preferably 400-1200 kN/m, more preferably 1000-1200 kN/m.

Conventional pre-dryers and after-dryers for paper machines can also be used, and drying conditions are not specifically limited, either, and can be appropriately established within the range of conventional operation.

In the present invention, coating base papers of the present invention can be surface-treated by applying a clear coating solution based on starch, as appropriate, thereby improving the surface smoothness of the base papers as well as internal bond strength by penetration of adhesives. Coaters used here include rod metering size press coaters, blade metering size press coaters, gate roll coaters and 2-roll size presses, among which rod metering size press coaters are preferably used in terms of improvement in internal bond strength especially at high speed.

Starches used as major components of the clear coating solution include native starches and modified starches such as oxidized starches, esterified starches, cationized starches, enzyme-modified starches, aldehyde starches, etherified starches (wet fragmented hydroxyethyl etherified starches, dry fragmented hydroxyethyl etherified starches, etc.) preferably at a coating mass of 0.5-3.0 g/m$^2$ per side of a base paper. The starch content in the clear coating solution is preferably 50% solids by weight or more, more preferably 80% by weight.

Coating Base Papers

Base papers for coated printing paper prepared by the methods of the present invention preferably exhibit formation expressed as a formation index of 12.0 or less, more preferably 10.5 or less, especially 7.0 or less calculated from variations in light transmittance. It should be noted that the smaller the formation index, the better the formation of paper. The difference of 0.5 in the formation index can be observed as a difference in formation even with naked eye.

The basis weight of the base papers for coated printing paper is not specifically limited, either, but 20-80 g/m$^2$, preferably 25-60 g/m$^2$, more preferably 25-50 g/m$^2$ for enhanced effects.

Coated Papers

The present invention also relates to a method for producing a coated paper by using a coating base paper obtained as described above. In one embodiment, the present invention relates to a method for producing a coated printing paper, comprising applying a coating color on a coating base paper obtained by the present invention.

One preferred method for obtaining a coated paper according to the present invention is a process using a gap former type paper machine including an on-machine coater, more preferably a process using a gap former type paper machine including an on-machine coater at high machine speed, more preferably a process using a gap former type paper machine including an on-machine coater wherein a coated printing paper is prepared at high filler content and high machine speed. The present invention is preferably applied to paper machines including an on-machine coater because the present invention avoids runnability loss even if coated broke or the like is used as a papermaking raw material.

The precoating pigment color based on a pigment and an adhesive mainly uses ground calcium carbonate as pigment in combination with precipitated calcium carbonate, kaolin, clay, talc, satin white, plastic pigment, titanium dioxide, etc., depending on the quality required. Adhesives used in the pigment coating color include synthetic adhesives such as emulsions of various copolymers including styrene-butadiene copolymers, styrene-acrylic copolymers, ethylene-vinyl acetate copolymers, etc., and polyvinyl alcohols, maleic anhydride copolymers, as well as oxidized starches, esterified starches, enzyme-modified starches, etherified starches and cold water soluble starches obtained by flash-drying them. The pigment coating color of the present invention may contain various additives incorporated in conventional pigments for coated paper such as dispersants, thickeners, water retention agents, antifoamers, waterproofing agents, etc.

The precoating pigment color is preferably applied in an amount of 0.7-10.0 g/m$^2$, more preferably 1.0-5.0 g/m$^2$, most preferably 2-5 g/m$^2$ expressed as solids per side of a base paper. It is difficult to apply less than 0.7 g/m$^2$ due to the limitation of equipment, and if the concentration of the coating color is lowered, the coating color excessively penetrates into the base paper, thus impairing surface smoothness. When an amount of more than 10 g/m$^2$ is to be applied, the concentration of the coating color must be increased so that the coating mass becomes hard to control due to the limitation of equipment. After the precoated paper is dried, it may be pretreated by a calender such as a soft calender before a top coating pigment color is applied.

In the present invention, the compositions, contents, coating masses and the like of the pigment and adhesive in the top coating pigment color are not specifically limited, but may be as conventionally used. The coating color preferably has a concentration of 55-70%, and is typically applied at a coating mass of preferably 6-20 g/m$^2$, more preferably 6-14 g/m$^2$ expressed as solids per side. The coater for top coating is not specifically limited, but normally a fountain blade or a roll application blade whether it is an off- or on-machine coater.

The coated paper obtained by applying a top coating pigment color and then drying is calendered in the finishing step by a supercalender, soft calender, etc., as conventionally. The type of the calender and treatment conditions are not specifically limited, and known equipment such as conventional calenders consisting of a metal roll, soft nip calenders, hot soft nip calenders, etc. can be appropriately selected and conditions can be established within the range controllable by these equipment, depending on the quality goal value of the printing paper.

Preferred techniques for obtaining coated papers of the present invention include methods using a gap former type paper machine including an on-machine coater, or methods using a gap former type paper machine including an on-machine coater and also using a blade coater for coating, especially methods conveniently used at high machine speed and coating speed. The present invention is more effective when the papermaking process through the coating step take place continuously in-line using a gap former type paper machine including an on-machine coater and the finishing step also takes place in-line.

Coated printing papers obtained by the methods of the present invention have excellent print quality such as blister resistance. The basis weight of the coated papers is not limited, either, but greater benefits are provided typically at 30-120 g/m$^2$, preferably 35-100 g/m$^2$, more preferably 40-80 g/m$^2$. Moreover, the present invention is more effective when the papermaking process through the coating step take place continuously in-line using a gap former type paper machine including an on-machine coater.

Coated papers prepared from base papers for coated printing paper prepared by the present invention can be suitably used for various printing applications such as offset printing, gravure printing, etc.

Preparation of Stocks

In another aspect, the present invention provides a method for preparing a stock. Thus, the present invention provides a method for preparing a stock characterized in that a coagulant is added to at least one or more papermaking raw materials before mixing and a stock having a solids content of 1.5% or more containing the papermaking raw materials. Stocks prepared by the present invention can be suitably used for the preparation of coating base papers and coated papers among others.

EXAMPLES

The following examples further illustrate the present invention without, however, limiting the invention thereto as a matter of course. Unless otherwise specified, parts and % in the examples mean parts by weight and % by weight, respectively.

Determination methods used in the following experimental examples are shown below.

<Determination Methods>

(1) Determination Method of Retentions

The stock inlet raw material and white water having fallen through the wire (hereinafter referred to as wire white water) were tested for solids content and ash content. Ash content was determined by incinerating the solids in the stock inlet raw material and wire white water at 525° C.

Stock retention and ash retention were determined by equations (1) and (2) below, respectively.

$$\text{Stock retention}=100\times(A-B)/A \qquad \text{equation (1)}$$

A: Solids content (g/l) in the stock inlet raw material

B: Solids content (g/l) in the wire white water $$\text{Ash retention}=100\times(C-D)/C \qquad \text{equation (2)}$$

C: Ash content (g/l) in the stock inlet raw material

D: Ash content (g/l) in the wire white water (2) Determination Method of Formation of Paper Formation of paper was evaluated by a formation tester FMT-III from Nomura Shoji Co., Ltd. (based on variations in light transmittance). Lower values mean better formation.

(3) Determination Method of Internal Bond Strength of Paper

Internal bond strength was measured by L&W ZD Tensile Tester SE 155 (from Lorentzen & Wettre).

(4) Determination Method of Surface Roughness of Paper

Surface roughness was determined according to JIS P8151 by a Parker Print-Surf tester from MESSMER. Lower values mean lower surface roughness (better smoothness).

(5) Print Evaluation

Printing was performed in an offset rotary press (4 colors, B2T600 from Toshiba) using offset printing inks (LEO-ECO SOY M from Toyo Ink Mfg. Co., Ltd.) at a printing speed of 500 rpm and a dry paper surface temperature of 120° C. Printing reproducibility was visually evaluated according to the following standard (○: good, Δ: slightly poor, x: poor) in the halftone dot area of 50% black of the resulting print. The 4-color solid area was also tested for the presence or absence of blisters (○: no blister, Δ: few blisters, x: blisters occur).

Experiment 1

<Preparation of Base Papers for Coated Printing Paper>

(1) Paper machine: a roll and blade gap former type paper machine, or a blade gap former type paper machine.

(2) Pulp raw material formulation: 50% hardwood kraft pulp (freeness CSF=350 ml), 20% softwood kraft pulp (freeness CSF=600 ml), 30% deinked pulp (freeness CSF=240 ml).

(3) Filler content in paper (ash content in paper): Scalenohedral precipitated calcium carbonate (mean particle size 2.5 μm) was used in an amount appropriately adjusted to a desired ash content in paper.

Example 1

To a stock consisting of a mixture of pulp and filler were added 0.2% of an amphoteric polyacrylamide (DS4340 from Seiko PMC Corporation) as an internal synthetic dry paper strength agent based on the solids weight of the stock and 300 ppm of a cationic polyacrylamide-based retention aid having a weight-average molecular weight of 20,000,000 determined by intrinsic viscosity measurement (REALIZER R300 from SOMAR Corporation, cationic charge density 1.96 meq/g) based on the solids weight of the stock, and the mixture was treated in a roll and blade gap former type paper machine having a forming roll diameter of 1600 mm and including two tandem show presses at a machine speed of 1,600 m/min to form a base paper for coated printing paper having a basis weight of 44 g/m$^2$ and an ash content in the paper of 15%.

Example 2

A base paper for coated printing paper was obtained in the same manner as described in Example 1 except that 200 ppm of the retention aid of Example 1 was added.

Example 3

A base paper for coated printing paper was obtained in the same manner as described in Example 2 except that the retention aid of Example 2 was replaced by a cationic polyacrylamide-based retention aid having a weight-average molecular weight of 15,000,000 determined by intrinsic viscosity measurement (Hiholder H722 from Kurita Water Industries, Ltd.).

Comparative Example 1

To a stock consisting of a mixture of pulp and filler were added 0.2% of an amphoteric polyacrylamide (DS4340 from Seiko PMC Corporation) as an internal synthetic dry paper strength agent based on the solids weight of the stock and 300 ppm of a cationic polyacrylamide-based retention aid having a weight-average molecular weight of 9,000,000 determined by intrinsic viscosity measurement (DR8500 from HYMO Co., Ltd., cationic charge density 1.80 meq/g) based on the solids weight of the stock, and the mixture was treated in a roll and blade gap former type paper machine having a forming roll diameter of 1,600 mm at a machine speed of 1,600 m/min to give a base paper for coated printing paper having a basis weight of 44 g/m$^2$ and an ash content in the paper of 15%.

Comparative Example 2

A base paper for coated printing paper was obtained in the same manner as described in Comparative example 1 except that 500 ppm of the retention aid of Comparative example 1 was added.

Comparative Example 3

To a stock consisting of a mixture of pulp and filler were added 0.2% of an amphoteric polyacrylamide (DS4340 from Seiko PMC Corporation) as an internal synthetic dry paper strength agent based on the solids weight of the stock, and 300 ppm of a cationic polyacrylamide-based retention aid having a weight-average molecular weight of 9,000,000 determined by intrinsic viscosity measurement (DR8500 from HYMO Co., Ltd., cationic charge density 1.80 meq/g) based on the solids weight of the stock, and the mixture was treated in a roll and blade gap former type paper machine having a forming roll diameter of 1,600 mm at a machine speed of 1,600 m/min to give a base paper for coated printing paper having a basis weight of 44 g/m$^2$ and an ash content in the paper of 5%.

Comparative Example 4

To a stock consisting of a mixture of pulp and filler were added 0.2% of an amphoteric polyacrylamide (DS4340 from Seiko PMC Corporation) as an internal synthetic dry paper strength agent based on the solids weight of the stock, and 300 ppm of a cationic polyacrylamide-based retention aid having a weight-average molecular weight of 9,000,000 determined by intrinsic viscosity measurement (DR8500 from HYMO Co., Ltd., cationic charge density 1.80 meq/g) based on the solids weight of the stock, and the mixture was treated in a roll and blade gap former type paper machine having a forming roll diameter of 1,600 mm at a machine speed of 1,000 m/min to give a base paper for coated printing paper having a basis weight of 44 g/m$^2$ and an ash content in the paper of 15%.

Comparative Example 5

To a stock consisting of a mixture of pulp and filler were added 0.2% of an amphoteric polyacrylamide (DS4340 from Seiko PMC Corporation) as an internal synthetic dry paper strength agent based on the solids weight of the stock, and 300 ppm of a cationic polyacrylamide-based retention aid having a weight-average molecular weight of 20,000,000 determined by intrinsic viscosity measurement (REALIZER R300 from SOMAR Corporation, cationic charge density 1.96 meq/g) based on the solids weight of the stock, and the mixture was treated in a blade gap former type paper machine at a machine speed of 1,400 m/min to give a base paper for coated printing paper having a basis weight of 44 g/m$^2$ and an ash content in the paper of 15%.

TABLE 1

Evaluation of coating base papers

| | Former type | | Papermaking conditions | | | Cationic PAM-based retention aid | |
|---|---|---|---|---|---|---|---|
| | Type | Forming roll diameter (mm) | Machine speed (m/min) | Basis weight (g/m2) | Ash in paper (%) | Molecular weight(MW) | Content (ppm) |
| Example 1 | Roll & blade | 1600 | 1600 | 44.1 | 14.8 | 20,000,000 | 300 |
| Example 2 | Roll & blade | 1600 | 1600 | 43.8 | 15.1 | 20,000,000 | 200 |
| Example 3 | Roll & blade | 1600 | 1600 | 44.2 | 13.6 | 15,000,000 | 200 |
| Comparative example 1 | Roll & blade | 1600 | 1600 | 44.4 | 14.6 | 9,000,000 | 300 |
| Comparative example 2 | Roll & blade | 1600 | 1600 | 44.7 | 15.3 | 9,000,000 | 500 |
| Comparative example 3 | Roll & blade | 1600 | 1600 | 43.2 | 5.1 | 9,000,000 | 300 |
| Comparative example 4 | Roll & blade | 1600 | 1000 | 43.6 | 15.4 | 9,000,000 | 300 |
| Comparative example 5 | Blade | — | 1400 | 44.2 | 14.3 | 20,000,000 | 300 |

| | Retention | | | Paper quality | | |
|---|---|---|---|---|---|---|
| | Stock (%) | Ash (%) | Long runnability | Formation index (%) | Internal bond strength (kPa) | PPS roughness F/W(μm) |
| Example 1 | 62.2 | 34.4 | ○ | 6.2 | 706 | 5.7/5.6 |
| Example 2 | 55.8 | 27.8 | ○ | 5.2 | 675 | 5.8/5.6 |
| Example 3 | 58.1 | 30.3 | ○ | 5.4 | 681 | 5.3/5.1 |
| Comparative example 1 | 43.1 | 12.3 | x | 6.3 | 524 | 6.2/5.8 |
| Comparative example 2 | 49.2 | 16.8 | x | 8.6 | 561 | 6.1/5.7 |
| Comparative example 3 | 52.1 | 21.2 | ○ | 6.4 | 612 | 5.9/5.8 |
| Comparative example 4 | 58.4 | 25.4 | ○ | 7.1 | 635 | 5.8/5.6 |
| Comparative example 5 | 63.5 | 33.6 | ○ | 9.2 | 542 | 5.7/5.6 |

The results are shown in Table 1. When the cationic PAM-based retention aids of the examples were used, stock retention and ash retention were excellent and formation was also better as compared with the cases in which the retention aid of the comparative examples was used. Moreover, the products of the present invention improved in internal bond strength resulting from high retention of fine components.

If a cationic PAM-based retention aid having a low molecular weight is used, the effect of the dry paper strength agent decreases and internal bond strength decreases because of low retention of fine components in the paper due to excessively low stock retention and ash retention (Comparative examples 1-4). After long continuous operation, the low retention resulted in the accumulation of contaminants in the white water system as well as an increase in problems such as defects on paper surfaces, thereby hindering an efficient operation. In Comparative example 1, the retention of fine components greatly decreases and the difference in surface smoothness between both sides increases.

In Comparative example 5 using a blade gap former type paper machine, the machine speed remains at 1400 m/min because of the low drainage capacity. Despite of the inclusion of a paper strength aid, internal bond strength decreases probably because of localization of ash in the paper layers.

<Preparation of Coated Printing Papers>

(1) Precoating color: After 100 parts of ground calcium carbonate (HYDROCARB-90 from Shiraishi Calcium Kaisha Ltd.) was dispersed in water with 0.3 parts of a dispersant (Aron T-40 from Toagosei Co., Ltd.) using Cowles Disperser, 15 parts of a starch phosphate ester and 3 parts of styrene-butadiene latex were added as adhesives to prepare a precoating pigment color having a solids content of 48%.

(2) Top coating color: After 70 parts of the ground calcium carbonate and 30 parts of kaolin were dispersed in water with 0.3 parts of a sodium polyacrylate-based dispersant using Cowless Disperser, 5 parts of a starch phosphate ester and 10 parts of styrene-butadiene copolymer latex were added as adhesives to prepare a top coating pigment color having a solids content of 65%.

Example 4

The base paper for coated printing paper prepared in Example 1 was coated with the precoating color at 3 g/m$^2$ per side on both sides using a rod metering size press coater, and further coated with the top coating color at 8 g/m$^2$ per side on both sides using a blade coater. The resulting coated paper was surface-treated in a hot soft nip calender with 4 nips at a metal roll surface temperature of 150° C. and a linear pressure of 300 kg/cm to give a coated printing paper. In this example, the papermaking process through the coating step took place continuously in-line using a gap former type paper machine including an on-machine coater.

Example 5

A coated printing paper was obtained in the same manner as described in Example 4 except that the base paper for coated printing paper prepared in Example 3 was used.

Comparative Example 6

The base paper for coated printing paper prepared in Comparative example 1 was coated with the precoating color at 3 g/m$^2$ per side on both sides using a rod metering size press coater, and further coated with the top coating color at 8 g/m$^2$ per side on both sides using a blade coater. The resulting coated paper was surface-treated in a hot soft nip calender with 4 nips at a metal roll surface temperature of 150° C. and a linear pressure of 300 kg/cm to give a coated printing paper.

TABLE 2

Evaluation of coated papers

| | Papermaking conditions | | | Cationic PAM-based retention aid | | Paper quality | | |
|---|---|---|---|---|---|---|---|---|
| | Machine speed (m/min) | Basis weight (g/m2) | Ash in paper (%) | Molecular weight (MW) | Content (ppm) | Internal bond strength (kPa) | Printing reproducibility F/W | Blister |
| Example 4 | 1600 | 44.1 | 14.8 | 20,000,000 | 300 | 758 | ○/○ | ○ |
| Example 5 | 1600 | 44.2 | 13.6 | 15,000,000 | 200 | 745 | ○/○ | ○ |
| Comparative example 6 | 1600 | 44.4 | 14.6 | 9,000,000 | 300 | 601 | Δ/○ | x |

The experimental results are shown in Table 2. All samples improved in internal bond strength over the base papers because the precoating pigment color was applied, but blisters occurred in the print results in Comparative example 6. This seems to result from the low strength of the base paper.

When the present invention is carried out to prepare a base paper for coated printing paper by neutral papermaking under high-speed and high-ash conditions using a roll and blade gap former type paper machine including a drainage mechanism based on a drainage blade immediately downstream of initial drainage via a forming roll, a base paper for coated printing paper having good formation and internal bond strength can be stably prepared continuously for a long period, which also has advantageous effects on the subsequent coated paper. Thus, the present invention is extremely effective. The present invention is more effective when the papermaking process through the coating step take place continuously in-line using a gap former type paper machine including an on-machine coater and the finishing step also takes place in-line, as described in Examples 4 and 5.

Experiment 2

<Preparation of Base Papers for Coated Printing Paper>

(1) Paper machine: a roll and blade gap former type paper machine including a drainage mechanism based on a drainage blade immediately downstream of initial drainage via a forming roll.

(2) Pulp raw material formulation: 50% hardwood kraft pulp (freeness CSF=350 ml), 20% softwood kraft pulp (freeness CSF=600 ml), 30% deinked pulp (freeness CSF=240 ml).

(3) Filler content in paper: Scalenohedral precipitated calcium carbonate (mean particle size 3.5 μm) was used in an amount appropriately adjusted to a desired ash content in paper.

Example 6

To a stock consisting of a mixture of pulp and filler were added 0.25% of a cationized starch (Cato304 from Nippon NSC Ltd.) as an internal paper strength aid based on the solids weight of the stock, 0.2% of a synthetic paper strength aid (EX288 from Harima Chemicals Inc.) based on the solids weight of the stock, and 400 ppm of a cationic polyacrylamide-based retention aid having a weight-average molecular weight of 10,000,000 determined by intrinsic viscosity measurement (DP7833 from Ciba Specialty Chemicals) based on the solids weight of the stock, followed by 1000 ppm of an anionic inorganic microparticle bentonite (Hydrocol-O from Ciba Specialty Chemicals) based on the solids weight of the stock, and the mixture was treated in a roll and blade gap former type paper machine having a forming roll diameter of 1600 mm at a machine speed of 1,600 m/min to give a base paper for coated printing paper having a basis weight of 37 g/m$^2$ and an ash content in the paper of 15%.

Example 7

A base paper for coated printing paper was obtained in the same manner as described in Example 6 except that the anionic inorganic microparticle of Example 6 was replaced by colloidal silica (NP442 from Eka Chemicals Co., Ltd.).

Example 8

A base paper for coated printing paper was obtained in the same manner as described in Example 6 except that a crosslinked polyacrylamide (Percoll M8 from Ciba Specialty Chemicals) as an organic microparticle was used in addition to the anionic particle of Example 6.

Example 9

A base paper for coated printing paper was obtained in the same manner as described in Example 6 except that the retention aid of Example 6 was replaced by a cationic polyacrylamide-based retention aid having a weight-average molecular weight of 20,000,000 determined by intrinsic viscosity measurement (R-300 from SOMAR Corporation).

Example 10

A base paper for coated printing paper was obtained in the same manner as described in Example 6 except that the retention aid of Example 6 was replaced by a branched cationic polyacrylamide-based retention aid having a weight-average molecular weight of 20,000,000 determined by intrinsic viscosity measurement (R-101 from SOMAR Corporation).

Comparative Example 7

A base paper for coated printing paper was obtained in the same manner as described in Example 6 except that the retention aid was changed to a cationic polyacrylamide-based retention aid having a weight-average molecular weight of 9,000,000 determined by intrinsic viscosity measurement (DR8500 from HYMO Co., Ltd., cationic charge density 1.80 meq/g) and the anionic inorganic microparticle bentonite (Hydrocol-O from Ciba Specialty Chemicals) was not added in Example 6.

Comparative Example 8

A base paper for coated printing paper was obtained in the same manner as described in Example 6 except that the cationic polyacrylamide-based retention aid (DP7833 from Ciba Specialty Chemicals) was not added in Example 6.

Comparative Example 9

To a stock consisting of a mixture of pulp and filler were added 0.25% of a cationized starch (Cato304 from Nippon NSC Ltd.) as an internal paper strength aid based on the solids weight of the stock, 0.2% of a synthetic paper strength aid (EX288 from Harima Chemicals Inc.) based on the solids weight of the stock, and 400 ppm of a cationic polyacrylamide-based retention aid having a weight-average molecular weight of 10,000,000 determined by intrinsic viscosity measurement (DP7833 from Ciba Specialty Chemicals) based on the solids weight of the stock, followed by 1000 ppm of an anionic inorganic microparticle bentonite (Hydrocol-O from Ciba Specialty Chemicals) based on the solids weight of the stock, and the mixture was treated in a blade gap former type paper machine at a machine speed of 1,300 m/min to give a base paper for coated printing paper having a basis weight of 37 g/m$^2$ and an ash content in the paper of 15%.

TABLE 3

Evaluation of coating base papers

| | | Internal paper strength aid | | Retention aid | | | |
|---|---|---|---|---|---|---|---|
| | Former type | | Content (ppm) | Cationic PAM | Content (ppm) | Anionic microparticle | Content (ppm) |
| Example 6 | Roll & blade | Cationized starch | 0.25 | DP7833 | 400 | Bentonite | 1000 |
| Example 7 | Roll & blade | Cationized starch | 0.25 | DP7833 | 400 | Colloidal silica | 300 |
| Example 8 | Roll & blade | Cationized starch | 0.25 | DP7833 | 400 | Crosslinked polyacrylamide | 400 |
| Example 9 | Roll & blade | Cationized starch | 0.25 | R-300 | 400 | Bentonite | 1000 |
| Example 10 | Roll & blade | Cationized starch | 0.25 | R-101 | 400 | Bentonite | 1000 |
| Comparative example 7 | Roll & blade | Cationized starch | 0.25 | DR8500 | 400 | — | — |
| Comparative example 8 | Roll & blade | Cationized starch | 0.25 | — | — | Bentonite | 1000 |
| Comparative example 9 | Blade | Cationized starch | 0.25 | DP7833 | 400 | Bentonite | 1000 |

| | Retention | | | | |
|---|---|---|---|---|---|
| Experimental example | Stock (%) | Ash (%) | Long runnability | Internal bond strength (kPa) | Formation index |
| Example 6 | 56.3 | 24.8 | ○ | 698 | 6.3 |
| Example 7 | 55.8 | 22.7 | ○ | 677 | 6.7 |
| Example 8 | 58.4 | 26.5 | ○ | 706 | 6.1 |
| Example 9 | 60.2 | 28.5 | ○ | 709 | 6.9 |
| Example 10 | 61.1 | 29.3 | ○ | 691 | 6.6 |
| Comparative example 7 | 48.3 | 18.9 | x | 592 | 7.2 |
| Comparative example 8 | 32.7 | 7.8 | x | 511 | 4.7 |
| Comparative example 9 | 61.2 | 28.4 | ○ | 661 | 9.8 |

The experimental results are shown in Table 3. The examples of the present invention achieved high internal bond strength and stock retention as well as good long runnability while maintaining good formation of paper.

When a cationic PAM (molecular weight 10,000,000) and an anionic microparticle were used in combination as retention aids, retention improved. Thus, the combination of a cationic PAM and an anionic microparticle as retention aids curbs a rise in white water consistency and prevents contamination in the system, thus enabling a long continuous operation.

In Comparative example 9 using a blade gap former type paper machine, the machine speed is as low as 1300 m/min and the retention is good, but formation is poor.

<Preparation of Coated Printing Papers>

(4) Preparation of Pigment Coating Colors

Precoatin color: After 100 parts of ground calcium carbonate (HYDROCARB-90 from Shiraishi Calcium Kaisha Ltd.) was dispersed in water with 0.3 parts of a dispersant (Aron T-40 from Toagosei Co., Ltd.) using Cowles Disperser, 15 parts of a starch phosphate ester and 3 parts of styrene-butadiene latex were added as adhesives to prepare a precoating pigment color having a solids content of 48%.

Top coating color: After 70 parts of the ground calcium carbonate and 30 parts of kaolin were dispersed in water with 0.3 parts of a sodium polyacrylate-based dispersant using Cowless Disperser, 5 parts of a starch phosphate ester and 10 parts of styrene-butadiene copolymer latex were added as adhesives to prepare a top coating pigment color having a solids content of 65%.

Example 11

To a stock consisting of a mixture of pulp and filler were added 0.25% of a cationized starch (Cato304 from Nippon NSC Ltd.) as an internal paper strength aid based on the solids weight of the stock, 0.2% of a synthetic paper strength aid (EX288 from Harima Chemicals Inc.) based on the solids weight of the stock, and 400 ppm of a cationic polyacrylamide-based retention aid having a weight-average molecular weight of 10,000,000 determined by intrinsic viscosity measurement (DP7833 from Ciba Specialty Chemicals) based on the solids weight of the stock, followed by 1000 ppm of an anionic inorganic microparticle bentonite (Hydrocol-O from Ciba Specialty Chemicals) based on the solids weight of the stock, and the mixture was treated in a roll and blade gap former type paper machine having a forming roll diameter of 1600 mm at a machine speed of 1,600 m/min to give a coating base paper having a base paper basis weight of 37 g/m$^2$ and an ash content of 15% in the base paper, which was then coated with the precoating color at 3 g/m$^2$ per side on both sides using a rod metering size press coater, and further coated with the top coating color at 8 g/m$^2$ per side on both sides using a blade coater. The resulting coated paper was surface-treated in a hot soft nip calender with 4 nips at a metal roll surface temperature of 150° C. and a linear pressure of 300 kg/cm to give a coated printing paper. In this example, the paper was produced in-line continuously from papermaking through coating methods using a gap former type paper machine including an on-machine coater.

Example 12

A coated printing paper was obtained in the same manner as described in Example 11 except that the coating base paper obtained in Example 9 was used.

Example 13

A coated printing paper was obtained in the same manner as described in Example 11 except that the coating base paper obtained in Example 10 was used.

Comparative Example 10

A coated printing paper was obtained in the same manner as described in Example 11 except that the retention aid was changed to a cationic polyacrylamide-based retention aid having a weight-average molecular weight of 9,000,000 determined by intrinsic viscosity measurement (DR8500 from HYMO Co., Ltd., cationic charge density 1.80 meq/g) and the anionic inorganic microparticle bentonite (Hydrocol-O from Ciba Specialty Chemicals) was not added in Example 8.

TABLE 4

Evaluation of coated papers

| | | Internal paper strength aid | | Retention aid | | | | Printing evaluation | |
|---|---|---|---|---|---|---|---|---|---|
| | Former type | Type | Content (ppm) | Cationic PAM | Content (ppm) | Anionic microparticle | Content (ppm) | Printing reproducibility | Blister |
| Example 11 | Roll & blade | Cationized starch | 0.25 | DP7833 | 400 | Bentonite | 1000 | ○/○ | ○ |
| Example 12 | Roll & blade | Cationized starch | 0.25 | R-300 | 400 | Bentonite | 1000 | ○/○ | ○ |
| Example 13 | Roll & blade | Cationized starch | 0.25 | R-101 | 400 | Bentonite | 1000 | ○/○ | ○ |
| Comparative example 10 | Roll & blade | Cationized starch | 0.25 | DR8500 | 400 | — | — | Δ/○ | x |

The results are shown in Table 4. When a cationic PAM and an anionic microparticle are used in combination as retention aids, blister resistance improved. The present invention is more effective when the papermaking process through the coating step take place continuously in-line using a gap former type paper machine including an on-machine coater and the finishing step also takes place in-line, as described in the examples above.

Experiment 3

Evaluation of Stocks Using a Dynamic Drainage Jar

<Determination Methods>

(1) Determination Method of Cationic Demand

The filtrate of the stock through a 200-mesh wire was analyzed for cationic demand by a particle charge detector based on streaming potential measurement (Mutek PCD-02) on the basis of the amount of a 1/1000 N aqueous solution of polydiallyldimethylammonium chloride required to neutralize charge. The reduction ratio of cationic demand was determined by the equation below:

$$\text{Cationic demand reduction ratio}=100\times(A-B)/A$$

A: Cationic demand before adding a coagulant

B: Cationic demand after adding a coagulant.

(2) Determination Method of Turbidity

The filtrate of the stock through a filter paper (Whatman #41) was analyzed for absorbance by an absorptiometer to calculate turbidity on the basis of a calibration curve prepared with Formazin standard solution. The reduction ratio of turbidity was determined from the turbidities before and after adding a coagulant in the same manner as for the reduction ratio of cationic demand.

Experimental Example A1

DBP (dry broke pulp, solids content 3.5%) was gently stirred with 300 ppm of a coagulant diallyldimethylammonium chloride/acrylamide (DADMAC/AA, N7527 from Katayama Nalco Inc.) using a laboratory stirrer for 5 minutes. DBP containing the coagulant, NBKP (softwood kraft pulp, freeness CSF: 600 ml) and LBKP (hardwood kraft pulp, freeness CSF: 350 ml) were mixed with a filler (scalenohedral precipitated calcium carbonate: mean particle size 3.5 μm) in proportions of 30% DBP, 20% NBKP, 40% LBKP and 10% filler and adjusted to a solids content of 2.5% with water to prepare a stock mixture.

The stock mixture was placed in a DDJ (dynamic drainage jar) with a stirrer at 1600 rpm, and after 10 seconds, 200 ppm of the coagulant was added, and the mixture was maintained with stirring for 180 seconds, after which turbidity and cationic demand were determined. On the basis of these results, the reduction ratios were calculated from the turbidity and cationic demand of a stock mixture (control) prepared by simply stirring in DDJ for 10 seconds with no coagulant added.

Experimental Example A2

A stock was prepared in the same manner as described in Experimental example A1 except that 500 ppm of the coagulant DADMAC/AA was also added to DIP (deinked pulp, freeness CSF: 240 ml, solids content 3.5%) and the stock formulation was 30% DBP, 20% NKP, 30% LKP, 10% DIP, 10% filler.

Experimental Example A3

A stock was prepared in the same manner as described in Experimental example A1 except that 500 ppm of the coagulant DADMAC/AA was added to DIP (deinked pulp, freeness CSF: 240 ml, solids content 3.5%), 1000 ppm of the coagulant DADMAC/AA was added to GP (groundwood pulp, freeness CSF: 80 ml, solids content 3.2%) and the stock formulation was 30% DBP, 20% NKP, 25% LKP, 10% DIP, 5% GP, 10% filler.

Experimental Example B1

A stock was prepared in the same manner as described in Experimental example A1 except that 1000 ppm of the coagulant DADMAC/AA was added to DBP and no coagulant was added to the stock mixture.

Experimental Example B2

A stock was prepared in the same manner as described in Experimental example A2 except that 1000 ppm of the coagulant DADMAC/AA was added to DBP and no coagulant was added to the stock mixture.

Experimental Example B3

A stock was prepared in the same manner as described in Experimental example A3 except that 1000 ppm of the coagulant DADMAC/AA was added to DBP and no coagulant was added to the stock mixture.

TABLE 5

Evaluation of stocks in a dynamic drainage jar

| Experimental example | Coagulant content (ppm) Added to DBP | Added to DIP | Added to GP | Added to stock mixture | Total content | Turbidity reduction % | Cationic demand reduction % |
|---|---|---|---|---|---|---|---|
| A1 | 300 | — | — | 200 | 290 | 53 | 41 |
| A2 | 300 | 500 | — | 200 | 340 | 48 | 37 |
| A3 | 300 | 500 | 1000 | 200 | 390 | 41 | 28 |
| B1 | 1000 | — | — | 0 | 300 | 35 | 22 |
| B2 | 1000 | 500 | — | 0 | 350 | 23 | 17 |
| B3 | 1000 | 500 | 1000 | 0 | 400 | 18 | 7 |

※ Total content: the amount of the coagulant based on solids (including filler).

The experimental results are shown in Table 5. A comparison between Experimental example A1 and Experimental example B1 shows that when a coagulant was added to both of the raw material DBP and the stock mixture containing the raw material, the reduction ratios of turbidity and cationic demand increased despite of the nearly equal total content of the coagulant as compared with the case where the coagulant was added to DBP alone. This indicates that anionic colloidal particles responsible for deposit problems or defects on paper surfaces in paper machines called white pitch were efficiently fixed to fibers, suggesting that when a retention aid is added to this stock, the retention aid could sufficiently perform to confer high retention.

Similarly, a comparison of the results between Experimental example A2 and Experimental example B2 and between Experimental example A3 and Experimental example B3 shows that when a coagulant was added to raw materials and the stock mixture at two stages, the reduction ratios of turbidity and cationic demand increased as compared with the case where the coagulant was added to raw materials alone, and the effect of multistage addition was remarkable especially in the system containing 10% DIP and the system containing 5% GP.

Experiment 4

<Evaluation of Coating Base Papers>

The number of defects in coating base paper was measured by using an on-line defect detector (KP83WY26-NVPDFi from OMRON Corporation) to determine the average number of defects per winder frame.

Filler distribution, formation coefficient and internal bond strength were evaluated on samples of base paper collected from the middle of a roll. Filler distribution was observed by a burnout test and visually evaluated according to the 3-class scale below (○: good, Δ: uneven, x: significantly uneven). Formation coefficient was determined by a formation tester FMT-III (based on variations in light transmittance). Lower formation coefficients mean better formation. Internal bond strength was measured by L & WZD Tensile Tester SE155 (from Lorentzen & Wettre).

<Evaluation of Coated Papers>

The number of dirts of 0.05 mm or more on the surface of the coated paper obtained by applying a coating on a coating base paper was counted by image analysis using SpecScan2000 (from Apogee Technology, Inc.).

Printing was performed in an offset rotary press (B2T600, 4 colors, from Toshiba) using offset printing inks (LEO-ECO SOY M from Toyo Ink Mfg. Co., Ltd.) at a printing speed of 500 rpm and a dry paper surface temperature of 120° C. Printing reproducibility was visually evaluated according to the following standard (○: good, Δ: slightly poor, x: poor) in the halftone dot area of 50% black of the resulting print.

<Preparation of Pigment Coating Colors>

Precoating color: After 100 parts of ground calcium carbonate (HYDROCARB-90 from Shiraishi Calcium Kaisha Ltd.) was dispersed in water with 0.3 parts of a dispersant (Aron T-40 from Toagosei Co., Ltd.) using Cowles Disperser, 15 parts of a starch phosphate ester and 3 parts of styrene-butadiene latex were added as adhesives to prepare a precoating pigment color having a solids content of 48%.

Top coating color: After 70 parts of the ground calcium carbonate and 30 parts of kaolin were dispersed in water with 0.3 parts of a sodium polyacrylate-based dispersant using Cowless Disperser, 5 parts of a starch phosphate ester and 10 parts of styrene-butadiene copolymer latex were added as adhesives to prepare a top coating pigment color having a solids content of 65%.

Example 14

A coagulant DADMAC/AA (N7527 from Katayama Nalco Inc.) was added to DBP (dry broke pulp, solids content 3.8%) at 500 ppm, and to DIP (deinked pulp, freeness CSF: 240 ml, solids content 3.4%) at 800 ppm, respectively. Raw materials including DBP containing the coagulant and DIP containing the coagulant were mixed in proportions of 30% DBP, 15% NBKP (softwood kraft pulp, freeness CSF: 600 ml), 15% LBKP (hardwood kraft pulp, freeness CSF: 350 ml), and 40% DIP in the mixing chest to prepare a stock (solids content 3.0%). In the mixing chest, 0.2% of a cationized starch (Cato304 from Nippon NSC Ltd.) was added at the same time, and then a dye was added.

Then, 1.0% of aluminum sulfate was added at the inlet of the mixing chest, and 400 ppm of the coagulant DADMAC/AA (N7527 from Katayama Nalco Inc.) was added to the stock having a solids content of 2.9% at the outlet of the mixing chest. In a machine chest following the mixing chest, 0.1% of a paper strength aid (EX280A from Harima Chemicals Inc.) was added. Then, neutral rosin and a filler (scalenohedral precipitated calcium carbonate: mean particle size 3.5 μm) were added as sizing agents, and 300 ppm of a retention aid having a weight-average molecular weight of 20,000,000 determined by intrinsic viscosity measurement (REALIZER R-300 from SOMAR Corporation) was further added upstream of the screen to prepare a stock (solids content 0.8%) containing the raw materials diluted with white water to a solids content of less than 1.5%.

This stock was delivered from an inlet module and treated in a roll and blade gap former type paper machine at a machine speed of 1600 m/min to give a coating base paper (basis weight 40.7 g/m$^2$, ash content in the paper 12%).

The resulting coating base paper was coated with the precoating color at 3 g/m$^2$ per side on both sides using a rod metering size press coater, and further coated with the top coating color at 8 g/m$^2$ per side on both sides using a blade coater. The coating speed was 1600 m/min. The resulting coated paper was surface-treated in a hot soft nip calender with 4 nips at a metal roll surface temperature of 150° C. and a linear pressure of 300 kg/cm to give a coated printing paper.

Comparative Example 11

A coating base paper and a coated paper were obtained in the same manner as described in Example 14 except that the retention aid was changed to a cationic polyacrylamide-based retention aid having a weight-average molecular weight of 9,000,000 determined by intrinsic viscosity measurement (DR8500 from HYMO Co., Ltd., cationic charge density 1.80 meq/g) and no coagulant was added to the mixing chest.

Comparative Example 12

A coated paper and a coating base paper were obtained in the same manner as described in Example 14 except that the retention aid was changed to a cationic polyacrylamide-based retention aid having a weight-average molecular weight of 9,000,000 determined by intrinsic viscosity measurement (DR8500 from HYMO Co., Ltd., cationic charge density 1.80 meq/g) and 400 ppm of the coagulant was added to the inlet raw material (solids content of the stock 0.8%) at the primary fan pump inlet with no coagulant added at the mixing chest outlet.

Comparative Example 13

A coated paper and a coating base paper were obtained in the same manner as described in Example 14 except that the retention aid was changed to a cationic polyacrylamide-based retention aid having a weight-average molecular weight of 9,000,000 determined by intrinsic viscosity measurement (DR8500 from HYMO Co., Ltd., cationic charge density 1.80 meq/g) and 400 ppm of the coagulant was added to the inlet raw material at the primary fan pump inlet with no coagulant added to DBP and DIP.

TABLE 6

Evaluation of coating base papers and coated papers

| Experimental example | Coagulant added to: Raw material | Mix chest | Primary pump | Cationic demand (μeq./l) | Turbidity (FTU) | Stock retention(%) |
|---|---|---|---|---|---|---|
| Example 14 | Yes | 400 ppm | No | 11.1 | 108 | 50.5 |
| Comparative example 11 | Yes | No | No | 21.9 | 205 | 43.2 |
| Comparative example 12 | Yes | No | 400 ppm | 6.8 | 101 | 46.4 |
| Comparative example 13 | No | 400 ppm | 400 ppm | 2.3 | 86 | 47.1 |

| Experimental example | Number of defects in base paper/frame: Large | Medium | Filler distribution | Formation index | Internal bond strength kPa | Number of dirts/ $m^2$ | Printing reproducibility |
|---|---|---|---|---|---|---|---|
| Example 14 | 0.014 | 0.122 | ○ | 5.2 | 620 | 5.0 | ○ |
| Comparative example 11 | 0.039 | 0.350 | ○ | 5.8 | 617 | 11.0 | ○ |
| Comparative example 12 | 0.050 | 0.118 | Δ | 7.2 | 608 | 17.0 | Δ |
| Comparative example 13 | 0.095 | 0.336 | Δ | 7.9 | 592 | 18.0 | Δ |

*The number of dirts on paper surface after coating (f 0.04 $mm^2$ or more)

The experimental results are shown in Table 6. Example 14 in which a coagulant was added to DBP and DIP as well as to a mixture of various raw materials in the mixing chest exhibited low turbidity and cationic demand and high retention. Moreover, the coating base paper of Example 14 exhibited a significantly low number of defects as well as good formation and filler distribution, resulting in high internal bond strength. The coated paper derived from this base paper showed little dirt on the paper surface and excellent printing reproducibility.

Moreover, the multistage addition of the coagulant reduced cationic demand and turbidity at the stock inlet, resulting in an increase in stock retention as compared with the cases in which the coagulant was added to DBP and DIP alone. Furthermore, the multistage addition of the coagulant reduced defects in the base paper and also reduced the number of dirts on the surface of the coated paper after coating.

When the coagulant was added to DBP and DIP and then the coagulant was added at the primary pump inlet after dilution with white water as shown in Comparative example 12, the reduction of cationic demand and turbidity at the stock inlet improved over Example 14 and the retention also tended to be high, but relatively large defects increased in the base paper. This is probably because colloidal substances as a source of foreign matter fixed in the raw material system were redispersed during the subsequent stock mixing step to the stock inlet around which the stock is diluted with a lot of white water, and then the colloidal substances gradually grew into coarse particles of foreign matter, which were then fixed to fibers by the coagulant added via the primary pump. The cohesive force extremely increased to affect formation and filler distribution, resulting in a decrease in internal bond strength. Moreover, the resulting coated paper contained many dirts on the paper surface and fell behind Example 14 in printing reproducibility.

When the coagulant was added at the mixing chest and primary pump inlet with no coagulant added to the raw materials as shown in Comparative example 13, the reduction of cationic demand and turbidity at the stock inlet improved over Example 14 and the retention also tended to be high in the same manner as in Comparative example 12, but defects in the base paper more significantly increased than those observed in Comparative example 12. This is probably because colloidal substances as a source of foreign matter were not fixed in a microscopic form to fibers, but destabilized by the addition of cationic chemicals such as aluminum sulfate or cationized starch and grown into very large particles of foreign matter, which were then efficiently incorporated into the paper by the coagulant. The cohesive force extremely increased to affect formation and filler distribution, resulting in a decrease in internal bond strength. Moreover, the resulting coated paper contained many dirts on the paper surface but also fell behind Example 14 in printing reproducibility.

Thus, the multistage addition of a coagulant reduces runnability problems such as deposits in high-speed papermaking using a gap former type paper machine, whereby coating base papers having high retention and even filler distribution and good formation can be prepared, and when these coating base paper are coated via a coater, coated papers with good quality can be obtained.

Example 15

To DBP (dry broke pulp, solids content 2.8%) was added 500 ppm of a polyvinylamine (Catiofast VSH from BASF) as a coagulant, and 800 ppm and 1200 ppm of a modified polyethyleneimine (Catiofast SF from BASF) was added as a coagulant to TMP (thermomechanical pulp, freeness CSF: 130 ml, solids content 3.4%) and GP (groundwood pulp, freeness CSF: 80 ml, solids content 3.5%), respectively. DBP, TMP and GP containing the coagulants and other raw materials were mixed in proportions of 20% DBP, 20% NBKP (softwood kraft pulp, freeness CSF: 80 ml), 30% LBKP (hardwood kraft pulp, freeness CSF: 380 ml), 15% TMP, and 15% GP in the mixing chest to prepare a stock (solids content about 3.0%). In the mixing chest, 1.0% of a cationized starch (Cato304 from Nippon NSC Ltd.) was added at the same time, and then a dye was added.

Then, 0.8% of aluminum sulfate was added at the inlet of the mixing chest, and 460 ppm of the coagulants were added at the outlet of the mixing chest. In a machine chest following the mixing chest, 0.2% of a paper strength aid (DS4340 from Seiko PMC Corporation) was added. Then, the stock diluted with white water to less than 1.5% was combined with AKD as a sizing agent and a filler (scalenohedral precipitated calcium carbonate: mean particle size 3.5 μm), followed by 400 ppm of a cationic polyacrylamide-based retention aid having a weight-average molecular weight of 10,000,000 determined by intrinsic viscosity measurement (DP7833 from Ciba Specialty Chemicals) based on the solids weight of the stock, then 1000 ppm of an anionic inorganic microparticle bentonite (Hydrocol-O from Ciba Specialty Chemicals) based on the solids weight of the stock.

This stock was delivered from the stock inlet and treated in a twin wire paper machine at a machine speed of 1200 m/min to give a coating base paper (basis weight 38.1 g/m$^2$, ash content in the paper 15%).

The resulting coating base paper was continuously coated with the precoating color at 2 g/m$^2$ per side on both sides using a rod metering size press coater, and further coated with the top coating color at 9 g/m$^2$ per side on both sides using a blade coater. The coating speed was 1200 m/min. The resulting coated paper was surface-treated in a hot soft nip calender with 4 nips at a metal roll surface temperature of 150° C. and a linear pressure of 350 kg/cm to give a coated printing paper.

Comparative Example 14

A coated paper was obtained in the same manner as described in Example 15 except that the retention aid was changed to a cationic polyacrylamide-based retention aid having a weight-average molecular weight of 9,000,000 determined by intrinsic viscosity measurement (DR8500 from HYMO Co., Ltd., cationic charge density 1.80 meq/g) and no coagulant was added at the outlet of the mixing chest.

TABLE 7

| | Coagulant added to | | Cationic | | Stock | Number of defects in base paper/frame | | Web breaks in |
|---|---|---|---|---|---|---|---|---|
| | Raw material | Mix chest | demand (μeq./l) | Turbidity (FTU) | retention (%) | Large | Medium | coater section |
| Example 15 | Yes | 460 ppm | 28.8 | 144 | 54.8 | 0.010 | 0.057 | ○ |
| Comparative example 14 | Yes | No | 41.9 | 259 | 51.5 | 0.031 | 0.240 | Δ |

The experimental results are shown in Table 7. The multistage addition of coagulants reduces turbidity and cationic demand at the inlet, suggesting that anionic colloidal substances as a source of deposits and defects were efficiently fixed to fibers. Resistance to web breaks in the coater section was evaluated according to the 3-class scale below (○: good, Δ: slightly poor, x: poor), showing that Example 15 resisted web breaks and had excellent retention and resistance to defects on the surface of the coated paper.

Thus, the multistage addition of coagulants can reduce defects or web breaks in on-machine coaters.

Example 16

To DBP and DIP (freeness CSF: 380 ml) was added 400 ppm and 200 ppm of a coagulant DADMAC/AA (N7527 from Katayama Nalco Inc.), respectively, and 800 ppm of a modified polyethyleneimine (Catiofast SF from BASF) was added as a coagulant to TMP (freeness CSF: 130 ml). DBP, DIP and TMP containing the coagulants and other raw materials were mixed in proportions of 20% DBP, 20% NBKP (freeness CSF: 580 ml), 20% LBKP (freeness CSF: 380 ml), 30% DIP, and 10% TMP in the mixing chest to prepare a stock. In the mixing chest, 1.0% of a cationized starch (Cato315 from Nippon NSC Ltd.) was added at the same time, and then a dye was added.

Then, 0.8% of aluminum sulfate was added at the inlet of the mixing chest, and 360 ppm of the coagulants were added at the outlet of the mixing chest. In a machine chest following the mixing chest, 0.2% of a paper strength aid (DS4340 from Seiko PMC Corporation) was added. Then, the raw material system diluted with white water to less than 1.5% and combined with AKD as a sizing agent and a filler (precipitated calcium carbonate), followed by 400 ppm of a retention aid having a molecular weight of 20,000,000 (REALIZER R-300 from SOMAR Corporation) to formulate a stock.

The formulated stock was delivered from the stock inlet and treated in a roll and blade gap former type paper machine at a machine speed of 1600 m/min, and the resulting coating base paper (basis weight 45.2 g/m$^2$, ash content in the paper 16%) was continuously in-line coated with the precoating color at 3 g/m$^2$ per side on both sides using a rod metering size press coater, and further coated with the top coating color at 10 g/m$^2$ per side on both sides using a blade coater. The coating speed was 1600 m/min. The resulting coated paper was further continuously in-line treated in a hot soft nip calender with 4 nips at a metal roll surface temperature of 150° C. and a linear pressure of 450 kg/cm to give a coated printing paper.

Comparative Example 15

A coating base paper and a coated paper were obtained in the same manner as described in Example 16 except that the retention aid was changed to a cationic polyacrylamide-based retention aid having a weight-average molecular weight of 9,000,000 determined by intrinsic viscosity measurement (DR8500 from HYMO Co., Ltd., cationic charge density 1.80 meq/g) and no coagulant was added in the mixing chest.

TABLE 8

| | Coagulant added to | | Cationic | | Stock | |
|---|---|---|---|---|---|---|
| | Raw material | Mix chest | demand (μeq./l) | Turbidity (FTU) | retention (%) | Web breaks |
| Example 16 | Yes | 360 ppm | 18.5 | 96 | 50.2 | ○ |
| Comparative example 15 | Yes | No | 37.8 | 221 | 46.0 | Δ |

The results are shown in Table 8. The multistage addition of coagulants reduces turbidity and cationic demand at the inlet, suggesting that anionic colloidal substances as a source of deposits and defects were efficiently fixed to fibers. Resistance to web breaks was evaluated according to the 3-class scale below (○: good, Δ: slightly poor, x: poor), showing that Example 16 resisted web breaks and also had high retention. Thus, the multistage addition of coagulants can reduce web breaks in paper machines.

The multistage addition of coagulants reduces runnability problems such as deposits during the papermaking process in paper machines especially at high speed, whereby coating base papers having high retention and even filler distribution and good formation can be prepared. When coating base papers of the present invention are coated via a coater, no problem with runnability such as web breaks occurs and coated papers with good quality can be prepared.

The invention claimed is:

1. A method for producing a base paper for coated printing paper by neutral papermaking using a paper machine with a gap former including a drainage mechanism based on a drainage blade immediately downstream of initial drainage via a forming roll, the method comprising the steps of: mixing one or more papermaking raw materials to prepare a stock; and converting the stock into paper; and comprising:

adding a cationic polyacrylamide-based material having a weight-average molecular weight of 10,000,000 or more determined by intrinsic viscosity measurement as a retention aid to a stock; and adding a coagulant to one or more raw material pulps and to the stock having a solids content of 1.5% or more.

2. The method of claim 1, comprising:

adding a cationized starch as a paper strength aid to a stock, and adding an anionic microparticle as a retention aid after the addition of the cationic polyacrylamide-based material.

3. The method of claim 1, further comprising diluting the stock with white water or process water downstream of a headbox of the paper machine after the addition of a coagulant to a stock having a solids content of 1.5% or more.

4. The method of claim 1, wherein the retention aid is added after the coagulant has been added.

5. The method of claim 1, wherein coated broke is used as one of the papermaking raw materials, and the method comprising adding a coagulant to the coated broke.

6. The method of claim 5, comprising adding a cationic polyvalent metal salt to the stock before the addition of the coagulant to the stock having a solids content of 1.5% or more.

7. The method of claim 1, wherein the stock is converted into paper a speed of 1300 m/min or more.

8. The method of claim 1, wherein the base paper has a filler content of 10% by weight or more.

9. The method of claim 1, wherein the stock include deinked pulp (DIP) in an amount of 20% by weight or more based on all pulps contained in the stock.

10. The method of claim 1, wherein the paper machine includes a shoe press.

11. The method of claim 1, wherein the paper machine includes an on-machine coater.

12. A method for producing a coated printing paper, comprising:

producing a base paper for coated printing paper by the process of claim 1, and applying a coating color containing a pigment and an adhesive on the base paper for, coated printing paper.

13. The method of claim 12 wherein the coating color is applied via a blade coater.

* * * * *